US007178246B2

(12) United States Patent
McCallum

(10) Patent No.: US 7,178,246 B2
(45) Date of Patent: Feb. 20, 2007

(54) WALLBOARD CUTTING TOOL

(76) Inventor: Gary McCallum, 4173 Delphem Court, Kelowna, Bristish Columbia (CA) V1W 4T1

( * ) Notice: Subject to any disclaimer, the term of this patent is extended or adjusted under 35 U.S.C. 154(b) by 0 days.

(21) Appl. No.: 11/337,567

(22) Filed: Jan. 24, 2006

(65) Prior Publication Data

US 2006/0201000 A1 Sep. 14, 2006

Related U.S. Application Data

(60) Provisional application No. 60/645,937, filed on Jan. 24, 2005.

(51) Int. Cl.
*B26D 29/00* (2006.01)

(52) U.S. Cl. ..... 30/293; 30/294; 30/299; 33/42

(58) Field of Classification Search ..... 30/293, 30/294, 287, 314, 299, 162; 33/42, 484, 33/485, 474, 479
See application file for complete search history.

(56) References Cited

U.S. PATENT DOCUMENTS

| | | | | |
|---|---|---|---|---|
| 1,100,878 | A | 6/1914 | Higgins et al. | |
| 1,445,546 | A | 2/1923 | Olson | |
| 1,577,569 | A | 3/1926 | Donley | |
| 2,090,183 | A | 8/1937 | Capstick | |
| 2,098,641 | A | 11/1937 | Cook | |
| 2,466,357 | A | 4/1949 | Beith | |
| 2,818,644 | A | 1/1958 | Crawford | |
| 2,835,037 | A | 5/1958 | Middents | |
| 3,174,225 | A | 3/1965 | Abraham | |
| 3,286,351 | A * | 11/1966 | McAlister | 33/42 |
| 3,439,426 | A | 4/1969 | Wilson | |
| 4,176,572 | A | 12/1979 | Pennington | |
| 4,646,439 | A | 3/1987 | Squires | |
| 4,903,409 | A | 2/1990 | Kaplan et al. | |
| 4,949,462 | A * | 8/1990 | Spencer | 30/293 |
| 4,977,673 | A | 12/1990 | Altizer | |
| 4,979,304 | A | 12/1990 | Sprague | |
| 5,033,197 | A | 7/1991 | Irvello | |
| 5,048,189 | A | 9/1991 | Aumess et al. | |
| 5,083,375 | A | 1/1992 | Helm, Sr. | |
| 5,197,195 | A | 3/1993 | Aikens | |
| 5,231,764 | A | 8/1993 | Chang | |
| 5,265,342 | A | 11/1993 | Lang, Jr. | |
| 5,309,642 | A | 5/1994 | McGinnis | |

(Continued)

*Primary Examiner*—Timothy V. Eley
*Assistant Examiner*—Omar Flores Sánchez
(74) *Attorney, Agent, or Firm*—Antony C. Edwards

(57) ABSTRACT

A cutting assembly is slidably mounted on a T-Square. The T-Square may include a scale having multiple indicia for measured cutting based on the size of the wallboard sheet being cut. The cutting assembly is mounted on a slider which may be clamped at measured positions along the arm of the T-Square. The cutting assembly includes oppositely disposed knife blades which are slidably mounted in a housing and spring loaded on opposite sides of a pivot mount such that when not in use the cutting assembly is urged to level and rests with the two knife blades retracted. As the housing is rotated so as to lower one end, the corresponding knife blade extends from the housing to engage with and score or cut the surface of the wallboard material. The cutting tool may be rotated in the opposite direction to thereby extend from the housing the other blade of the pair of oppositely disposed knife blades.

14 Claims, 27 Drawing Sheets

U.S. PATENT DOCUMENTS 5,404,647 A 4/1995 Prater
5,406,711 A 4/1995 Graham
5,471,750 A 12/1995 Deboi
5,471,753 A * 12/1995 Rodrigues ..... 33/42
5,488,773 A 2/1996 Fletcher
5,600,892 A 2/1997 Peugh et al.
5,732,472 A 3/1998 Praye
5,979,063 A 11/1999 Pritz
5,996,237 A 12/1999 Sanders
6,070,331 A 6/2000 Dempsey
6,467,174 B1 10/2002 Kotori
6,612,035 B2 9/2003 Brown et al.
6,629,370 B1 10/2003 Sposato
2001/0020334 A1 9/2001 Wrobbel
2001/0029673 A1 10/2001 Brown et al.
2002/0014012 A1 2/2002 Hoffman
2002/0032969 A1 3/2002 Cardew
2004/0055168 A1 3/2004 Allen

* cited by examiner

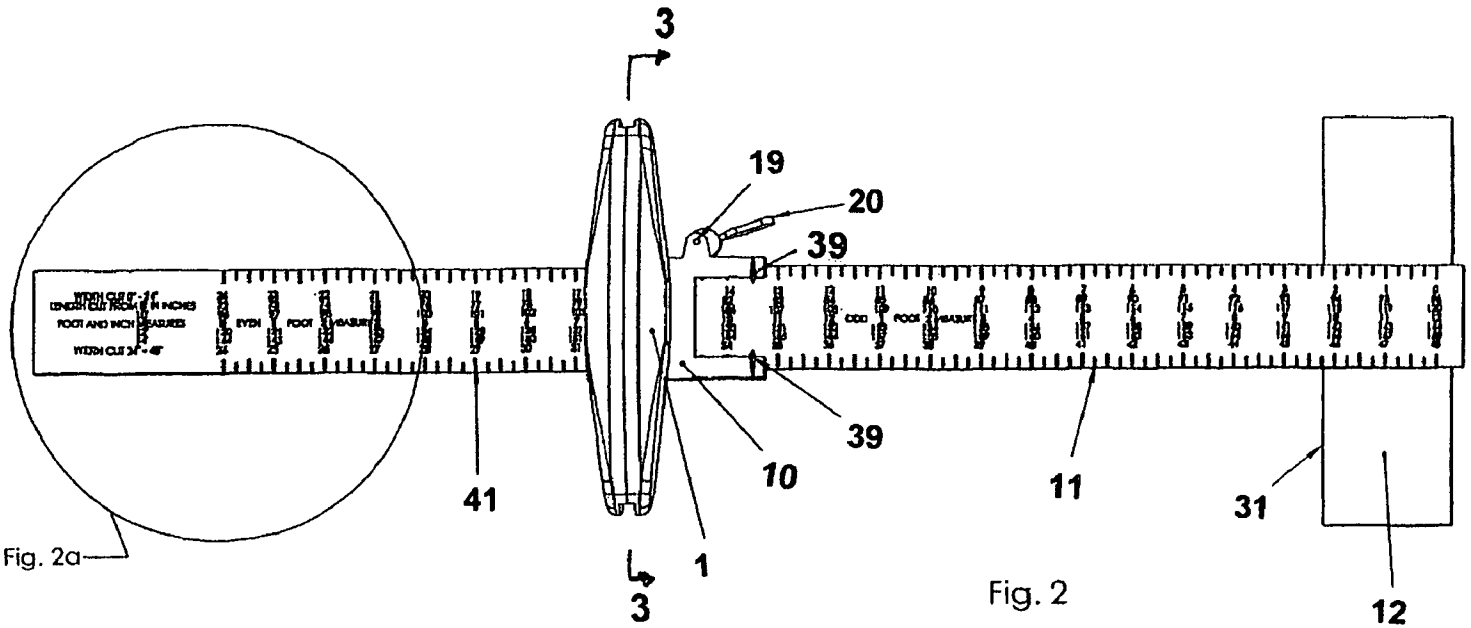
Fig. 2
Fig. 2a
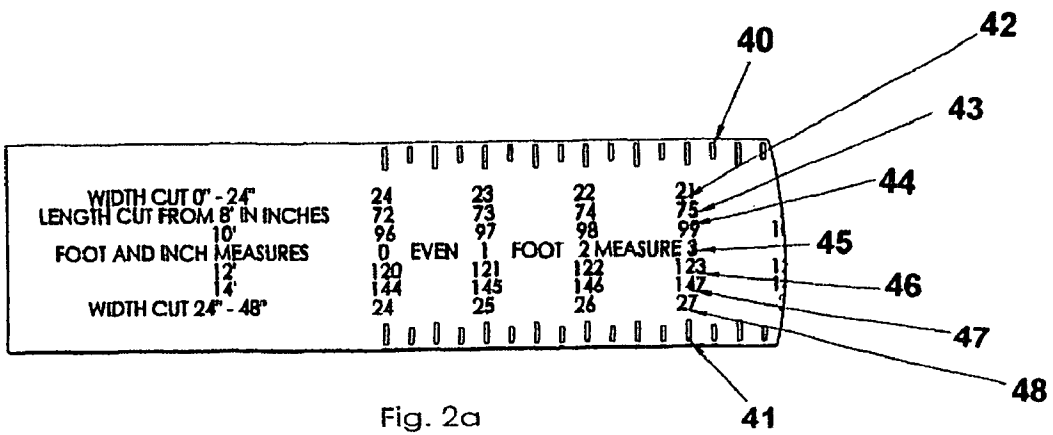
Fig. 2a

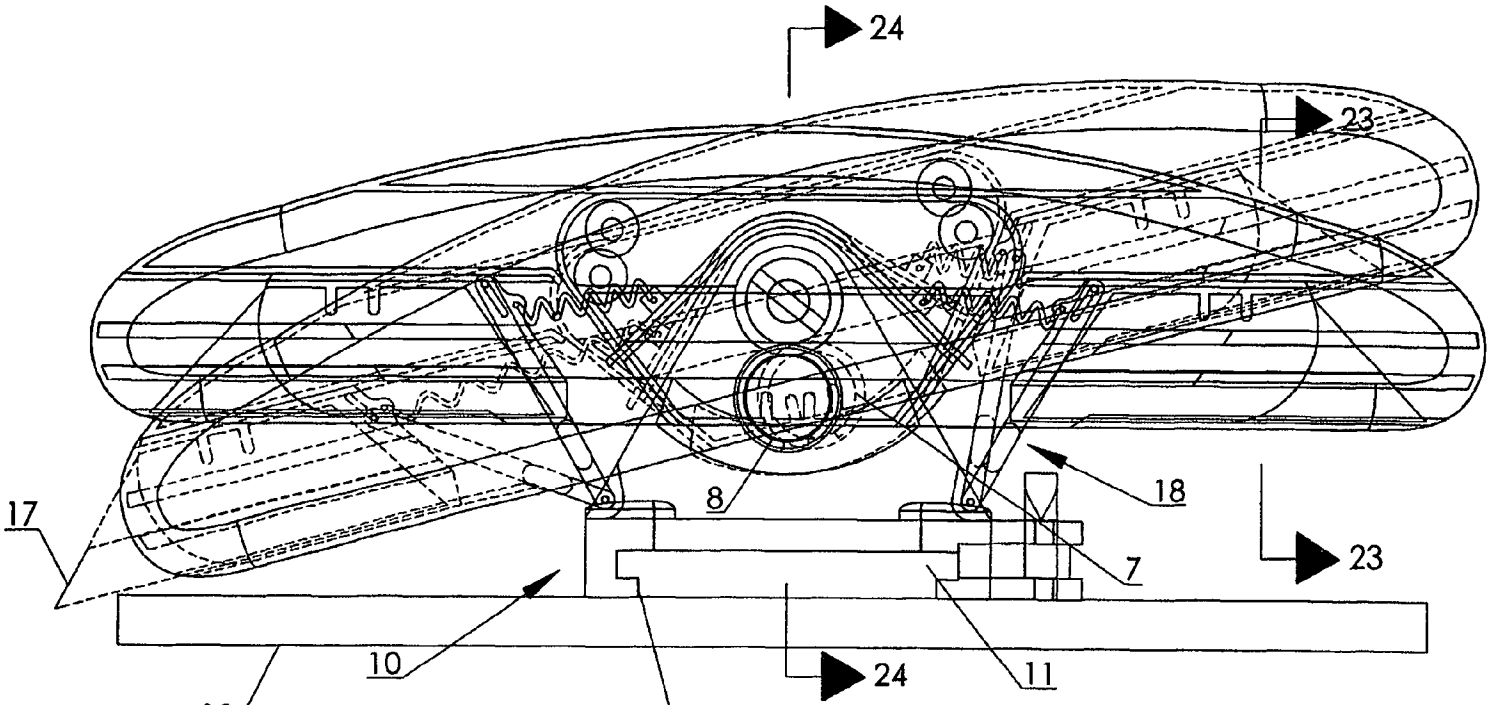
Fig 28
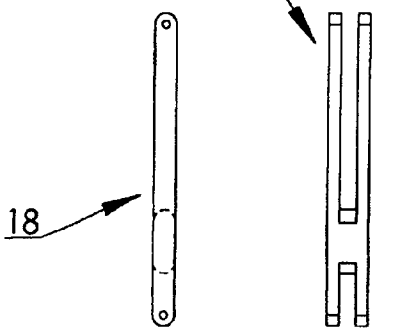
Fig 30b
Fig 30a
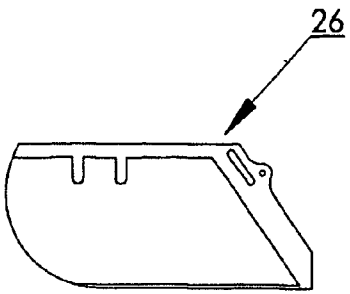
Fig 29

WALLBOARD CUTTING TOOL

CROSS REFERENCE TO RELATED APPLICATION

This application claims priority from U.S. Provisional Patent Application No. 60/645,937 filed Jan. 24, 2005 entitled Wallboard Cutting Tool.

FIELD OF THE INVENTION

This invention relates to tools and devices for accurately scoring or cutting wallboard or like material using a knife referenced to an edge surface of the wallboard being cut, and in particular to a combination of T-square and articulating knife.

BACKGROUND OF THE INVENTION

It is known that when scoring or cutting (collectively herein cutting) wallboard materials such as gypsum board, wallboard, plasterboard, insulation board, or like materials particularly in construction applications that time to perform cutting operations can be reduced and quality of cut increased when using cutting tools referenced to an edge of the wallboard material as in the case of a T-Square guided knife. Cutting of wallboard needs to be quite accurate in most cases as the material is often used in finishing interiors of buildings where fit ultimately affects the quality and appearance of the finish. Furthermore the cutting of wallboard materials should be quick and easy to maximize installer productivity and reduce overall cost of installation.

In most cases, wallboard materials can be cut by first scoring the surface, and then bending the board along the score line so as to break the board. Scoring a long line of 4 feet, typical gypsum board width, or even longer lines of 8 to 12 feet or more can be difficult without a referenced guide. Long straight edges often get bent and malformed due to miss-handling during the course of normal construction work and transportation between job sites. Several attempts aimed at resolving this challenge have been made as shown in U.S. Pat. No. 6,629,370 issued to Sposato on Oct. 7, 2003, which teaches of a board cutter including a T-Square and a common utility knife mounted to a slider which rides along the long leg of the T-Square and is fixed at a position by means of a clamp mechanism as in a thumb screw. The common utility knife is connected to the slider by way of a pivotal pin, and clamped into a depth of cut position again using a thumb screw arrangement. The primary drawback of the Sposato patent is that is difficult to cut the full face of a wallboard from edge to edge as the T-Square runs out before the knife has scored the whole length of the surface. This is particularly evident when cutting a wallboard while it is standing on end as when leaning against a wall, the leading end of the head of the T-Square is blocked by the floor or ceiling preventing the knife from reaching the edges closest to the obstructing floor or ceiling.

The problem of the guiding member or T-Square head of the scoring tool reaching the end of the wallboard sheet ahead of the cutting tool in either direction found in most of the prior art of which applicant is aware such as U.S. Pat. No. 6,467,174 issued to Kotori on Oct. 22, 2002, U.S. Pat. No. 5,471,753 issued to Rodrigues on Dec. 5, 1995, U.S. Pat. No. 5,309,642 issued to McGinnis on May 10, 1994, U.S. Pat. No. 5,231,764 issued to Chang on Aug. 3, 1993, U.S. Pat. No. 5,979,063 issued to Pritz on Nov. 9, 1999, and U.S. Pat. No. 2,098,641 issued to Cook on Apr. 15, 1936.

SUMMARY OF THE INVENTION

The present invention serves to improve the function and productivity of a wallboard scoring and cutting tool by way of a dual extending and retracting blade cutting assembly slidably attached to a T-Square wherein the T-Square may include a scale having multiple indicia for quick measured cutting based on the size of the wallboard sheet being cut. The cutting assembly is mounted on a slider, which can be clamped at measured positions along the ruler arm of the T-Square for example according to a scale imprinted on the ruler arm. The cutting assembly includes oppositely disposed knife blades which are slidably mounted in the housing and spring loaded on opposite sides of a pivotal mount such that when not in use the cutting assembly is urged to level and rests with the two knife blades retracted and the housing parallel to the upper surface of the ruler arm. The tool user engages the cutting device with the wallboard by pivoting the cutting device rocker housing down towards the wallboard material on the side opposite of the intended direction of travel of the T-Square (for sake of reference referred to below as the first direction). As the cutting device rocker housing is rotated so as to lower one end into its lowered operating position, the corresponding knife blade (for sake of reference referred to below as the first blade) located within the housing, which also serves as a handle, extends from the housing to engage with and score the surface of the wallboard material. The cutting tool is moved so as to slide along the surface of the wallboard material, guided by the fence of the T-Square riding along the edge of the wallboard material, until the T-square head encounters an obstacle or the end of the wallboard. The cutting tool is then released so as to resiliently urged by the springs in the housing to return the housing back to its neutral level resting position, the first blade simultaneously retracting into the housing. The cutting tool may then be rotated in the opposite direction to thereby extend from the housing the second blade of the pair of oppositely disposed knife blades so as to engage and score the wallboard surface when slid in a second direction opposite the first direction, thereby allowing the user of the tool to cut the full extent of the wallboard sheet from edge to opposite edge quickly and accurately.

In summary the wallboard cutter according to one aspect of the present invention may be characterized as including a rocker housing having oppositely disposed retractable cutting blade assemblies, the housing pivotally mounted about a pivot mount on a base, the base slidable along the ruler arm of a modified T-Square. In particular, the base is slidably mounted on the T-Square so as to selectively slide along an upper side of a ruler arm of the T-Square. The rocker housing is selectively pivotable about an axis of rotation parallel with the ruler arm. The oppositely disposed pair of cutting blade assemblies are slidably mounted in oppositely disposed coplanar array within a corresponding pair of cavities in the rocker housing. The pivot mount is positioned between the pair of cavities.

A drive linkage is mounted so as to cooperate between the base and the pair of cutting blades, alternatingly to either drive a cutting edge of a first blade assembly of the pair of cutting blade assemblies from the rocker housing in a first direction upon pivoting of a corresponding first side of the rocker housing downwardly and so as to simultaneously retain a second blade assembly of the pair of cutting blade assemblies within the rocker housing, or to drive the second blade assembly from the rocker housing in a second direction opposite the first direction upon pivoting of a corresponding second side of the rocker housing, opposite the first side, downwardly and so as to simultaneously retain the first blade assembly within the rocker housing. Thus when the first side of the rocker housing is pivoted downwardly about the pivot mount, the first blade assembly is rotated downwardly into cutting engagement with a sheet of wallboard when the T-Square is mounted on an edge of the sheet so as to lay the ruler arm flush on the sheet of wallboard, and when the second side of the rocker arm is pivoted downwardly about the pivot mount, the second blade assembly is rotated downwardly into cutting engagement with the sheet of wallboard again when the T-Square is mounted on the edge of the sheet so as to lay the ruler arm flush on the sheet of wallboard. Advantageously the rocker housing is adapted to provide a handle for gripping by a user so that the user, when gripping the handle, may translate the housing, blade assemblies, base and T-Square over the sheet of wallboard with the first or second blade assemblies in corresponding cutting engagement when the housing is simultaneously pivoted downwardly on the first or second side respectively.

In a preferred embodiment a resilient biasing means, such as an oppositely disposed pair of springs, is mounted in the housing and cooperates with the pair of cavities so as to resiliently bias the pair of blade assemblies inwardly of the housing into the cavities. The cavities are elongate so as to extend between oppositely disposed first and second openings in corresponding first and second sides of the housing and the resilient biasing means may include first and second resilient biasing means such as the pairs of springs. The drive linkage urges the first or second blade assemblies linearly along the corresponding first or second cavities upon corresponding downward pivoting of the first and second sides of the housing against the return biasing force of first and second resilient biasing means respectively. The drive linkage may include first and second drive arms rotatably mounted at first ends thereof to the base and rotatably mounted at opposite second ends thereof to the first and second blade assemblies respectively.

In one embodiment each of the first and second blade assemblies has a substantially vertical slot formed therein, wherein the second ends of the first and second drive arms are respectively slidably mounted in a corresponding substantially vertical slot whereby the upward rotational ranges of motion of the first and second sides of the housing are extended upwardly when the first and second blade assemblies are retracted into a stowed position within the corresponding the first or second cavity. Thus the opposite side, the second or first side of the housing respectively, have a corresponding extended downward rotational range of motion about the pivot mount.

The drive arms may be linear members and the pivot mount may be a pivot member such as a shaft, pin, axle etc extending between the base and the housing along the axis of rotation. The first ends of the drive arms are rotatably mounted on opposite adjacent sides of, and below, the pivot member. The substantially vertical slots may be formed in inwardly disposed ends of the blade assemblies.

The housing may be elongate so as to extend its longitudinal axis between the first and second openings in the housing so that the housing forms an elongate handle extending longitudinally along its length orthogonally from the axis of rotation. For example, the first and second openings may be at outermost distal ends of the first and second sides of the housing.

In preferred embodiments, a storage compartment may be formed in the housing for removably storing spare blades to replace blades in the first or second blade assemblies.

The base may further comprise a selectively releasable lock for locking the base at a selected position along the ruler arm. The ruler arm advantageously has a parallel array of length markings extending along a portion of the length of the ruler arm so that the blades are selectively positionable along the ruler arm at known distances, marked in the length markings, corresponding to dimensions of the sheet of wallboard when the T-Square is mounted on the sheet of wallboard.

In the preferred embodiment the first and second blade assembly includes first and second blades removably mounted so as to be carried in a corresponding first and second blade carrier mounted slidably in the corresponding first and second cavities for sliding translation along the first and second cavities in oppositely disposed first and second linear directions substantially radially outwardly of the pivot member. The substantially vertical slots may be formed in inner ends of the carriers corresponding to the inner ends of the blades. In particular, the blades may include first and second blades held in the carriers by sandwiching of inner ends of the blades within the carriers so as to leave outer ends of the blades disposed outwardly of the carriers, and outwardly along the cavities so that when in extended positions the carriers are within the cavities adjacent corresponding the openings and only the cutting edges protrude outwardly of the openings.

BRIEF DESCRIPTION OF THE DRAWINGS

In the accompanying figures, corresponding reference numerals denote corresponding parts in each view, wherein:

FIG. 2 is, in top view, a preferred embodiment of the wallboard cutting tool.

FIG. 2*a* is, a detail view of FIG. 2 showing the scale of the wallboard cutting tool.

FIG. 28 is, in elevation view, the cutting head assembly of FIG. 20 assembled and mounted onto a T-Square, the cutting head assembly depicted in both its neutral level position and with its left side pivoted downwardly so as to extend a blade from the lowered end.

FIG. 29 is, in elevation view, one half of the blade carrier according to the present invention.

FIG. 30*a* is, in side elevation view, one of the drive arms of the driving linkage driving the blade carriers along the ends of the cutting head rocker housing.

FIG. 30*b* is, in front elevation view, the drive arm of FIG. 30*a*.

DETAILED DESCRIPTION OF EMBODIMENTS OF THE INVENTION

Figure 1:
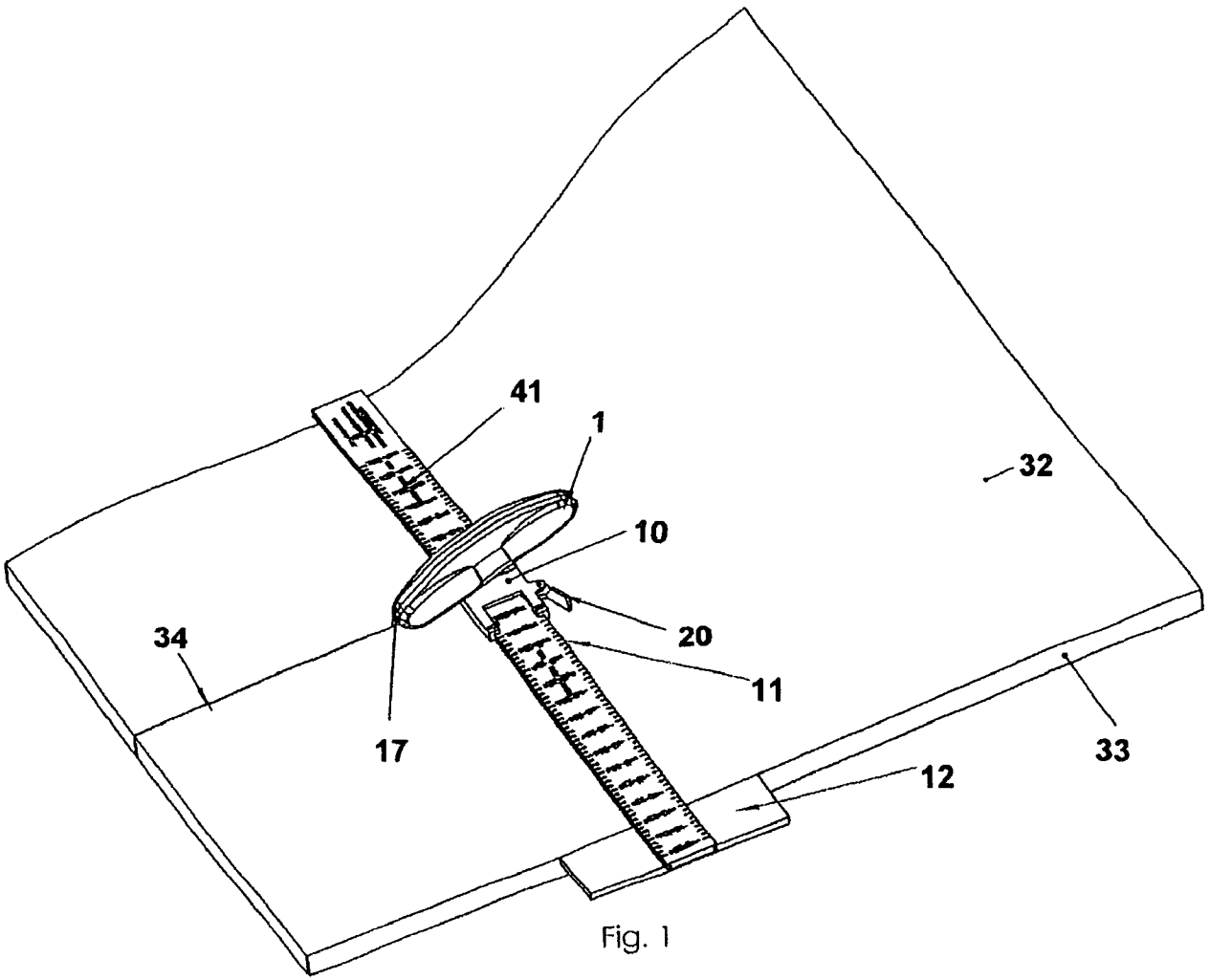
FIG. 1 is, in front perspective view, a preferred embodiment of the wallboard cutting tool in use scoring a wallboard panel.

The present invention is a wallboard cutting tool that aids in quick and accurate scoring or cutting of wallboard panels in preparation for installation of same. FIG. 1 shows the preferred embodiment of the present invention in use whereby a knife 17 within the handle body 1 is drawn across the surface of the wallboard 32 at a fixed distance from the wallboard edge 33, resulting in a cut or score-line 34 being made in the wallboard surface 32. The main body of the cutting head 1 is mounted on cutter head base 10, which is slidably mounted on T-Square ruler arm 11, and adjustably located and locked in position along T-Square arm 11 using a quick lock such as a cam lock 20. The T-Square fence 12 is slid along, in contact with, wallboard edge 33 thereby maintaining constant the distance between the knife blade 17 and wallboard edge 33 as the blade is drawn across the wallboard surface 32.

The wallboard cutting tool includes a T-Square and dual blade cutting head 1 pivotably mounted on a slidable base 10 that slides on the T-Square arm 11. The cutting locations of the knives 17 in cutter assembly 1 can be accurately fixed relative to the reference face 31 of the T-Square fence 12 by adjusting the cutter base 10 to locations marked on the T-Square arm 11 by aligning indicia pointers 39 on the cutter base 10 with the identical indicia markings 40 and 41 on opposite edges of T-Square arm 11. The indicia markings 40 and 41 are associated with scales 42 through 48 for quick measurement depending on the desired cut to be made. Scale 42 marks the distance between the reference face 31 of the T-square fence 12 and the knives 17 in cutter assembly 1 in inches and fractions thereof. Scale 43 marks the distance from the opposite end of an 8 foot long wallboard when the T-Square fence 12 is placed on the end of this length of wall board. Similarly scales 44, 46, and 47 mark the distance from the opposite end of 10, 12, and 14 foot long wallboards respectively when the T-Square fence 12 is placed on the respective end of these lengths of wall board. Scales for other lengths such as 16 foot long wallboards may also be provided. Scale 45 marks the distance from the odd and even foot from the reference face 31 of the T-Square fence 12. Scale 48 marks the distance between the reference face 31 of the T-square fence 12 and the knives 17 in the cutter assembly 1 in inches starting from 48 inches at the reference face and counting down to twenty-four inches at the far end, that is distal end of the scale. This scale is used to cut forty-eight inch wide panels to a width between twenty-four and forty-eight inches. The length of the scale is intended to be illustrative and not intended to be limiting as other lengths will work.

The main body 1 includes a housing which provides a handle. The housing, alternatively referred to herein as a handle, contains two knife blades 17 within the same cutting plane but oppositely positioned within the handle. Each blade 17 is slidably mounted in corresponding opposite ends of the housing and each is linked to the cutter head base 10 by linkage arms 18, the housing pivotally mounted by pivot pin 4 or other pivot mount member into base 10. The housing rotates about pivot pin 4 in direction A by applying a downward pressure such as force F to either end of the housing that is, offset from pivot pin 4. Rotating the rocker housing causes each arm 18 to engage its corresponding blade carrier 26. The end of each arm 18 which is mounted to carrier 26, is mounted so as to slide along a substantially vertical slot 28 in the inward ends of the blade carrier. On the end which is rotated downwardly, arm 18 is driven against the top end of slot 28 and thereby translates force F into travel of blade 26 in direction E that is, generally orthogonally to the direction of force F, thereby extending and tensioning the corresponding return spring 14. Each return spring 14 is mounted at its outward end to a corresponding inward end of its corresponding blade carrier 26. The inward ends of return springs 14 are mounted on opposite sides of pivot pin 14 so as to be anchored to the housing and substantially oppositely disposed. As first blade 17 is being extended, the other blade 17 (the second blade) under the influence of its corresponding return spring 14 and linkage arm 18, is carried in its corresponding blade carrier 26 so as to also slide in direction E until reaching the limit of its inward travel limit, at which point linkage arm pin 37 mounting arm 18 to slot 28 slides downwardly along slot 28, thereby permitting the cutter rocker 1 to continue to rotate so as to continue to extend the first blade from the downwardly disposed end of the housing and to maintain the second blade in its retracted position.

Figure 3:
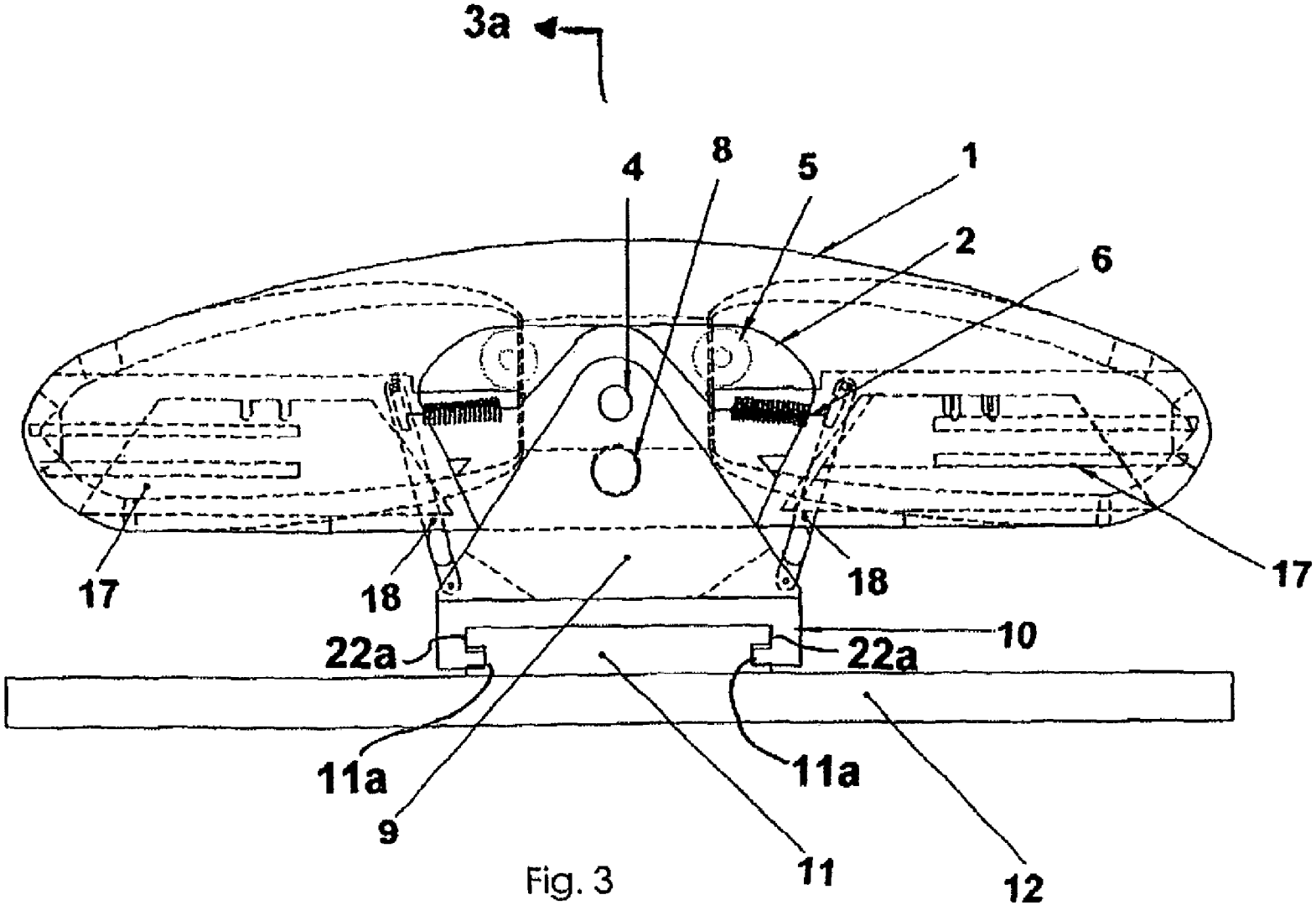
FIG. 3 is a cross sectional view along line 3—3 in FIG. 2 showing internal structure partially in dotted outline.
Figure 3A:
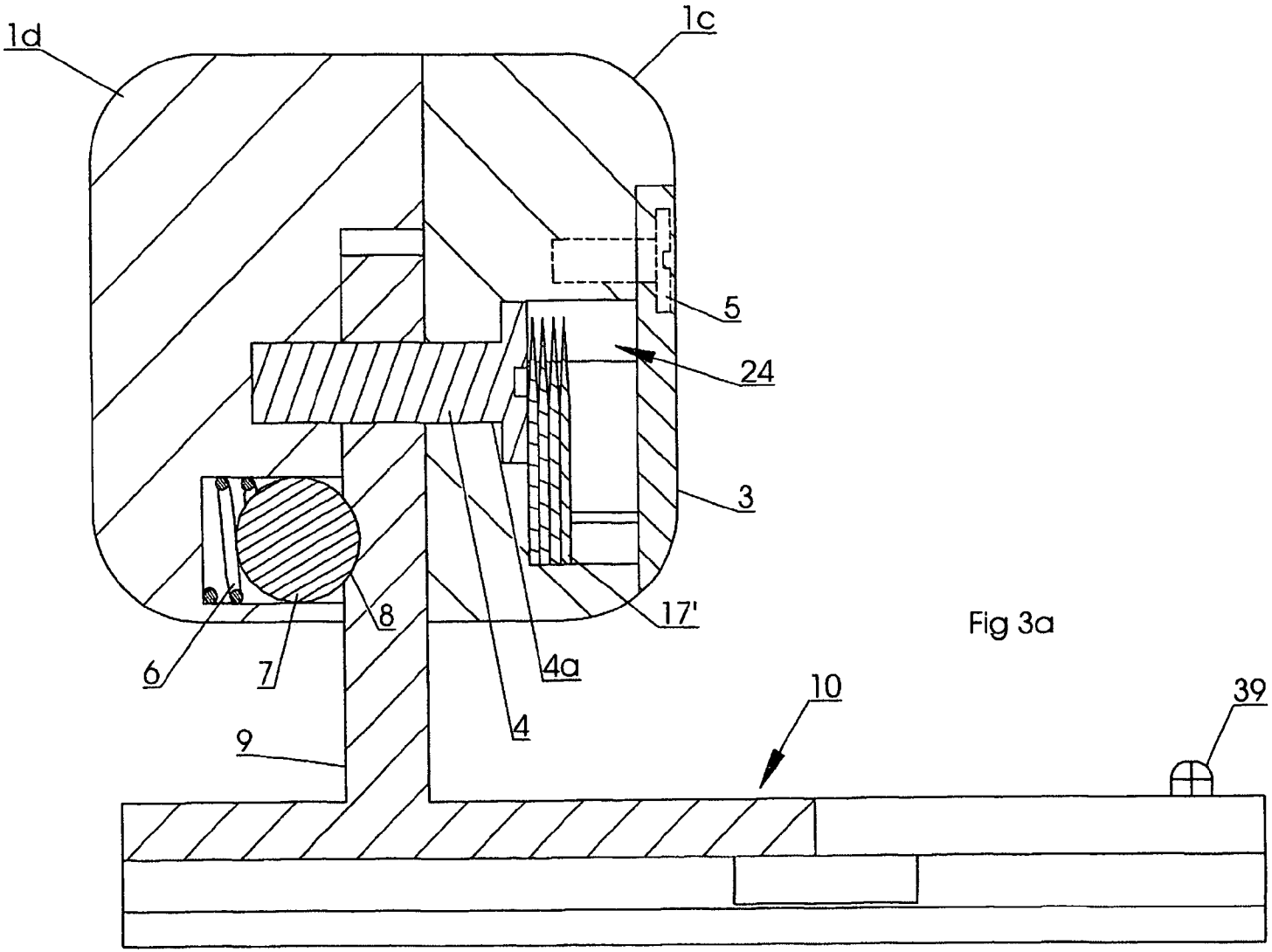
FIG. 3*a* is a cross sectional view along line 3*a*—3*a* in FIG. 3.
Figure 4:
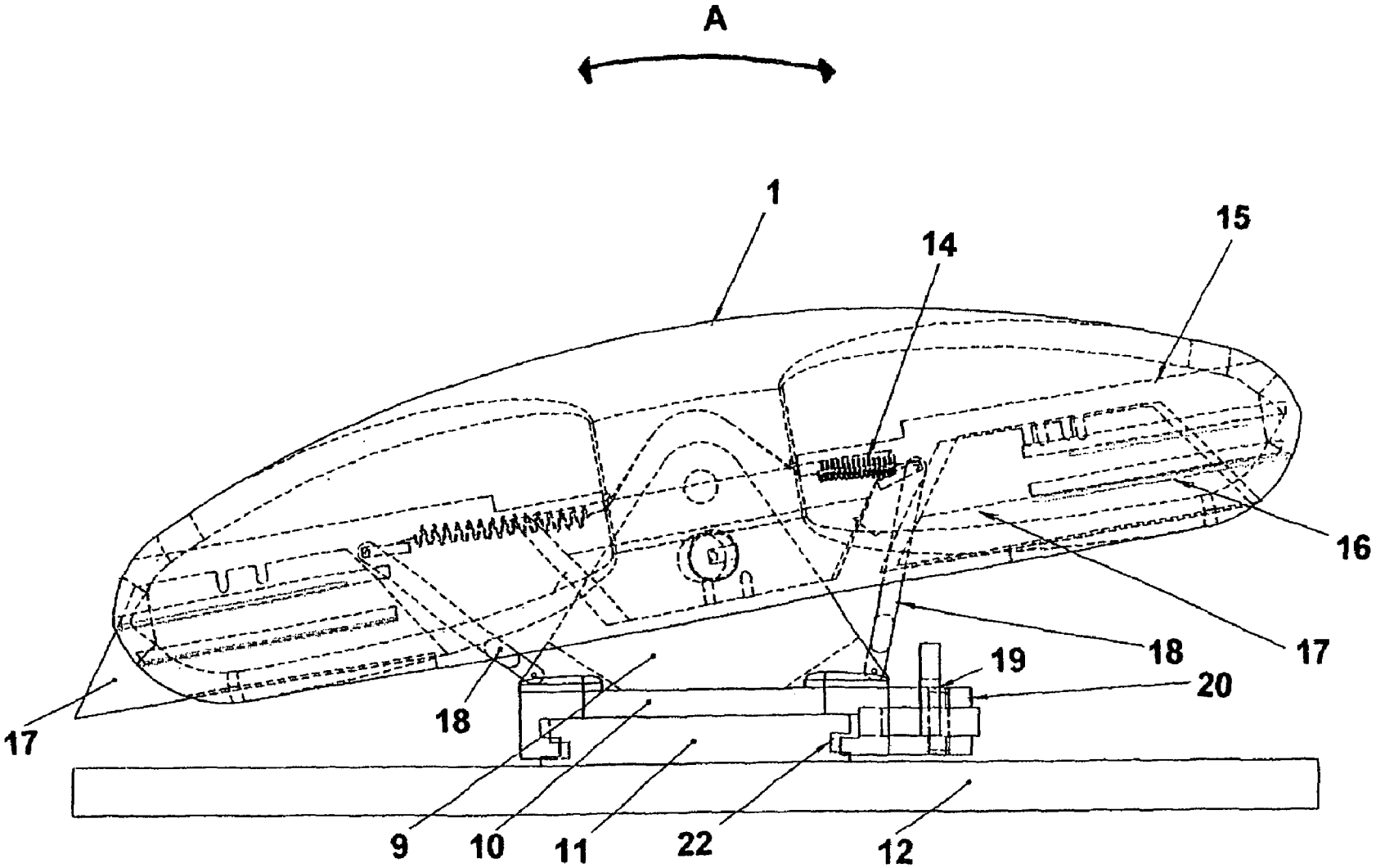
FIG. 4 is, in the right side elevation view of FIG. 3, of the wallboard cutting tool handle rotated into an operating position for cutting or scoring wallboard.
Figure 5:
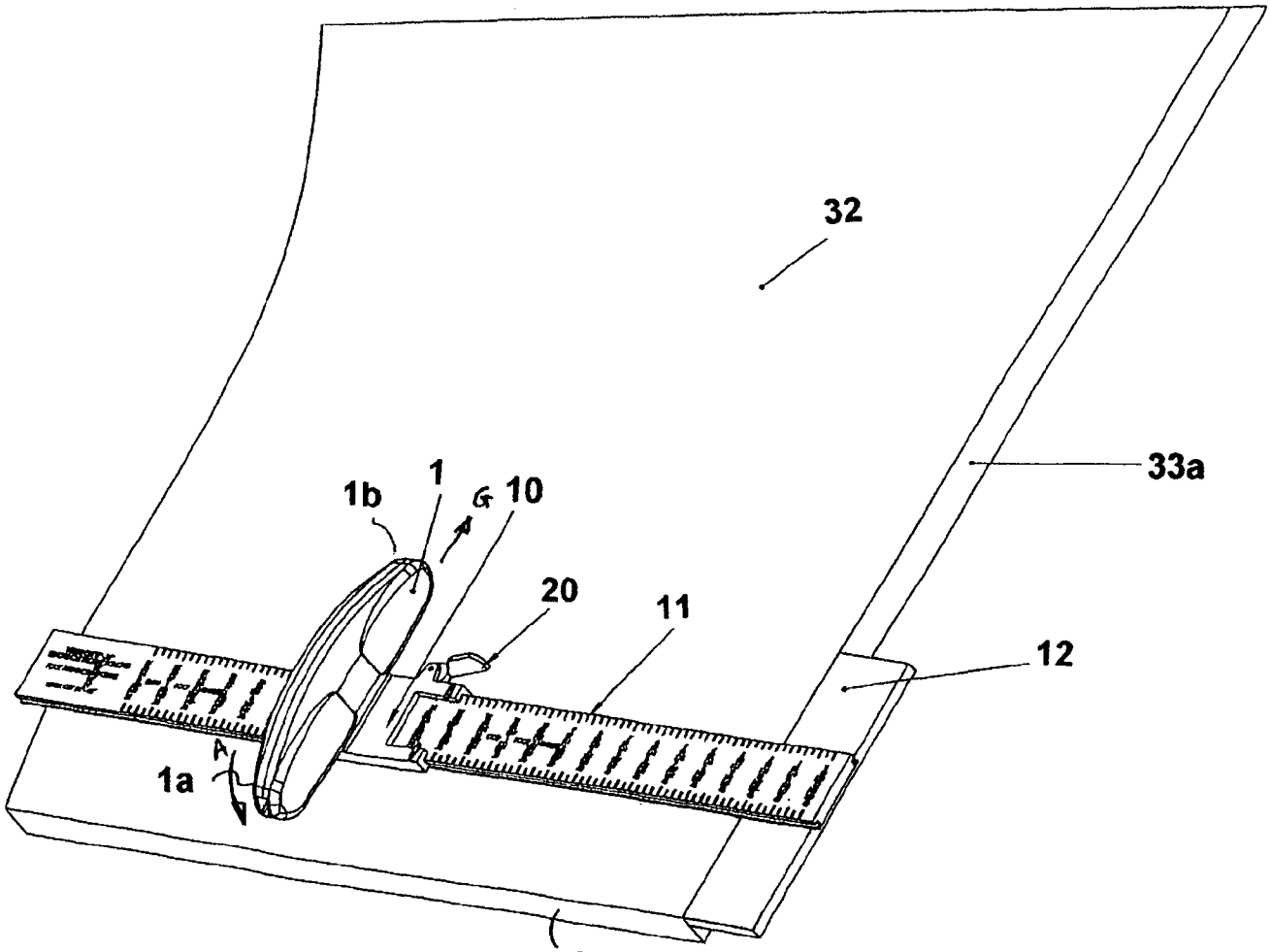
FIG. 5 is, in front perspective view, the wallboard cutting tool of FIG. 1 placed on a sheet of wallboard, positioned prior to making a cut.

The opposite resilient urging of springs 14 returns the cutting head housing automatically to its neutral (blades retracted) level position as shown in FIG. 3 when force F, that is the downward pressure of the operator's hand is removed. Centering ball spring 6 urges on centering pressure ball 7 through center depression 8 so as to releasably hold the housing in the level position.

Figure 6:
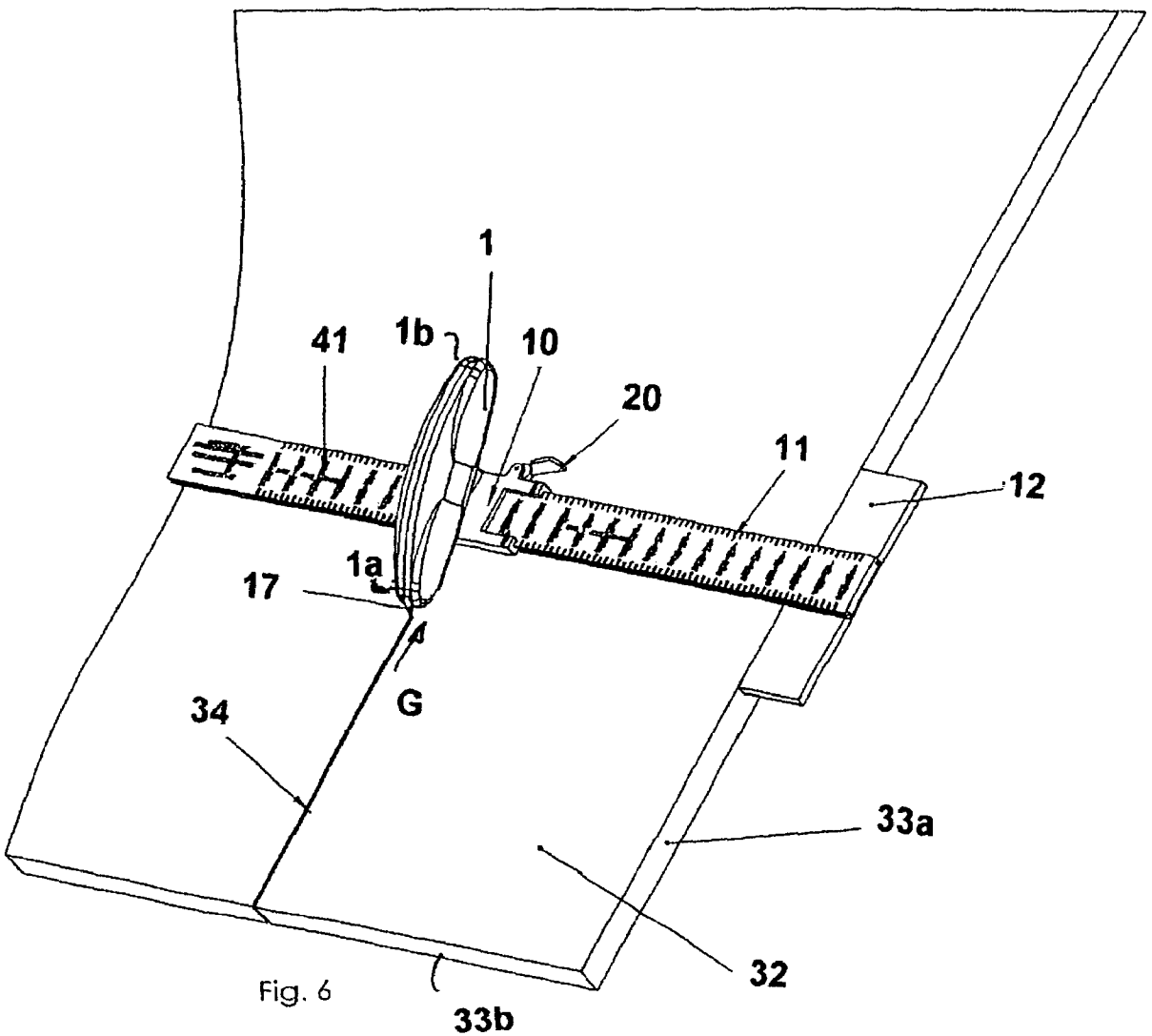
FIG. 6 is, in perspective view, the wallboard cutting tool of FIG. 5 in use, shown part way through making a cut or score on the wallboard.
Figure 7:
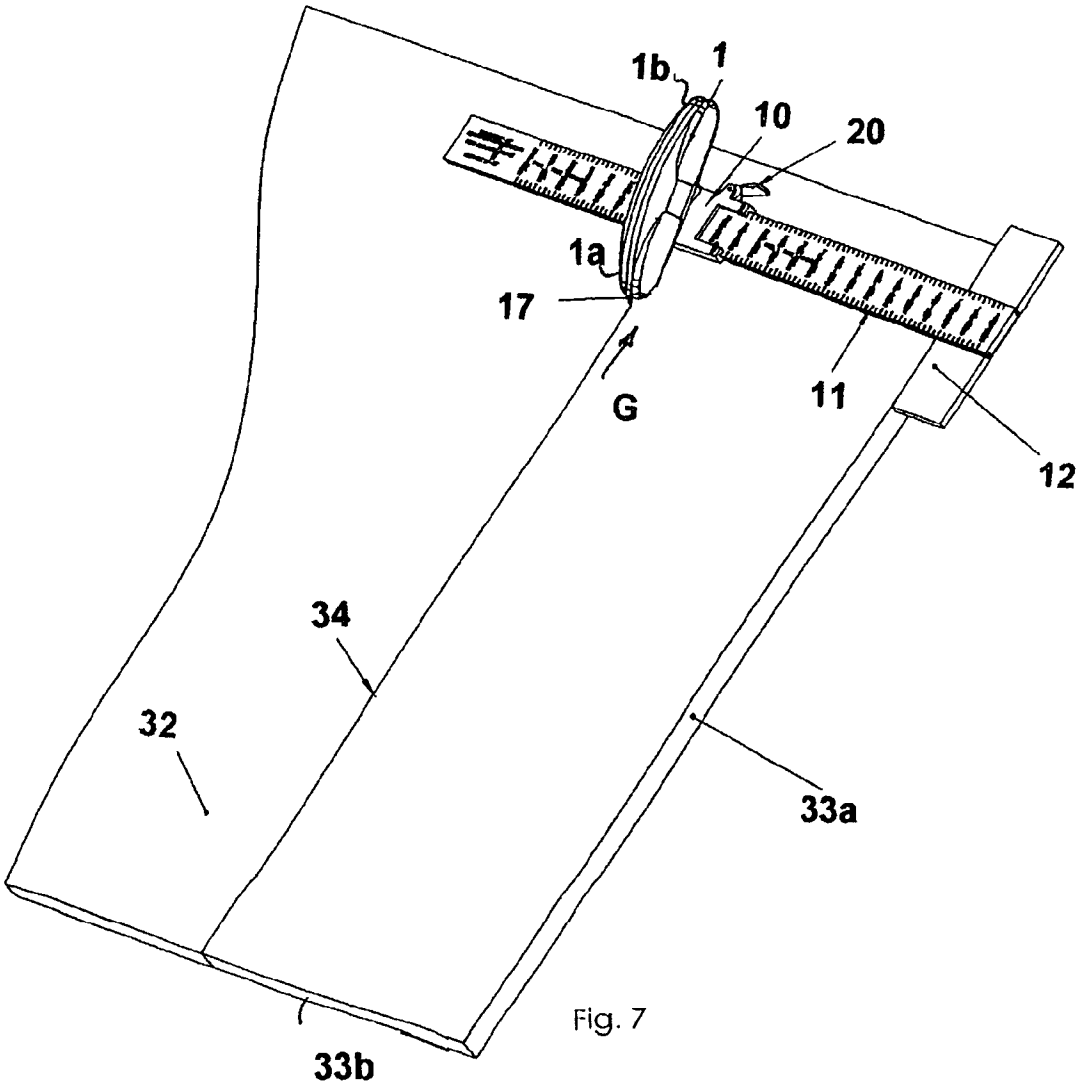
FIG. 7 is, in perspective view, the wallboard cutting tool of FIG. 6, in use, shown substantially most of the way through making a cut or score on the wallboard.
Figure 8:
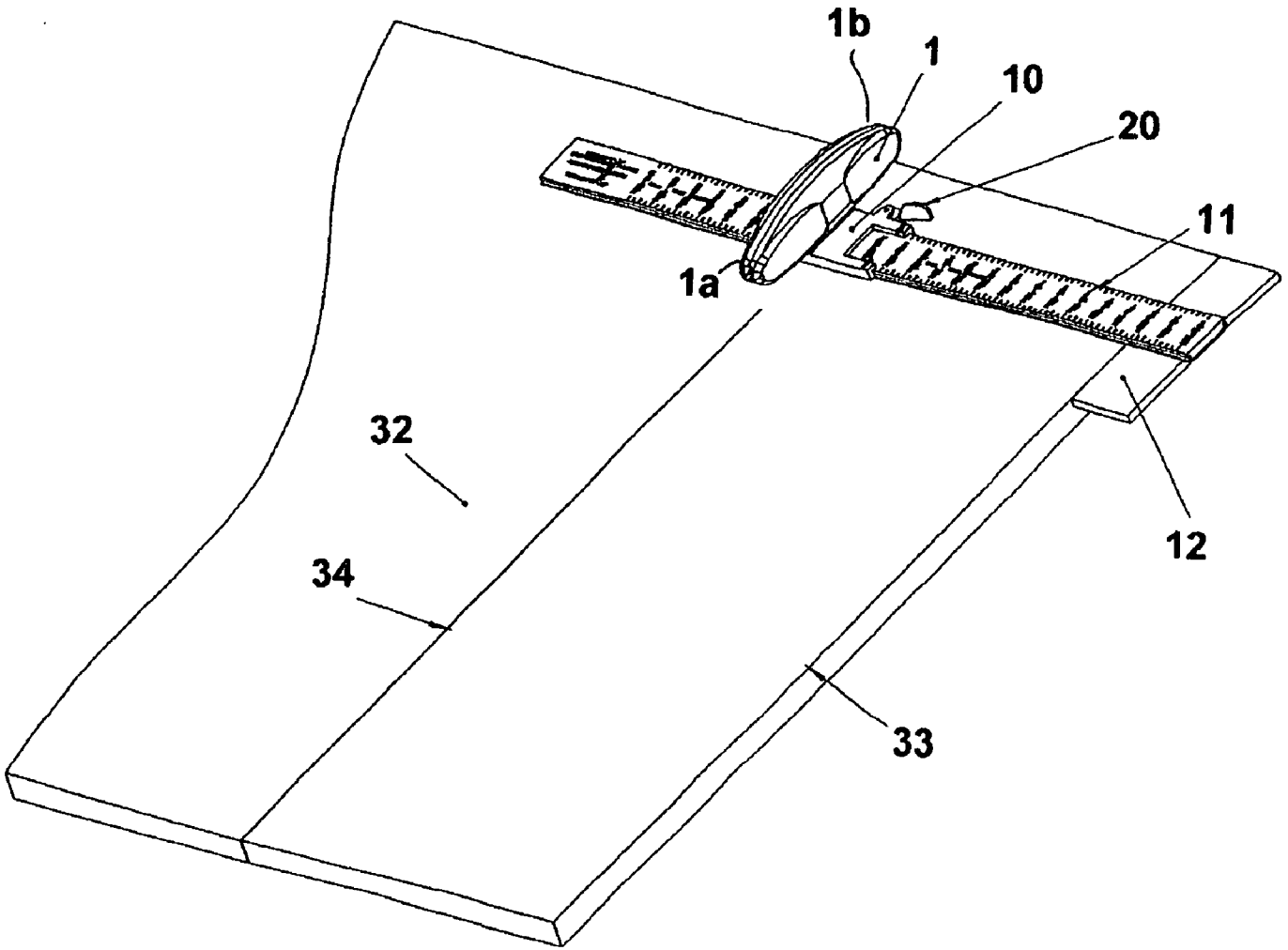
FIG. 8 is, in perspective view, the wallboard cutting tool of FIG. 7, shown substantially most of the way through making a cut or score on the wallboard, with the cutter in the neutral, blades retracted position.
Figure 9:
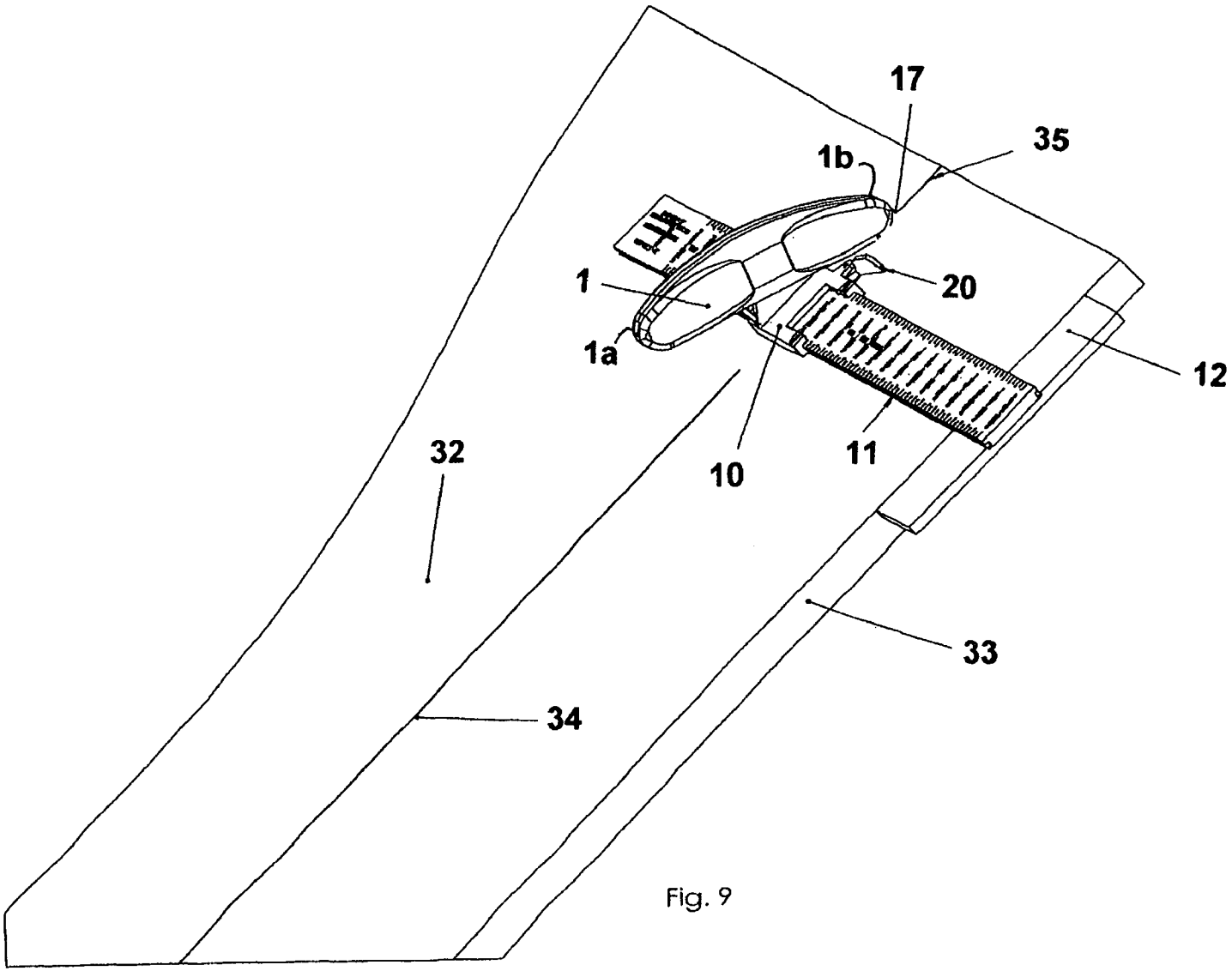
FIG. 9 is, in perspective view, the wallboard cutting tool of FIG. 8, shown operating in the reverse direction from FIGS. 6 and 7 making a reverse cut or score from the edge opposite the initial starting edge of the wallboard panel so as to join the two cuts.
Figure 10:
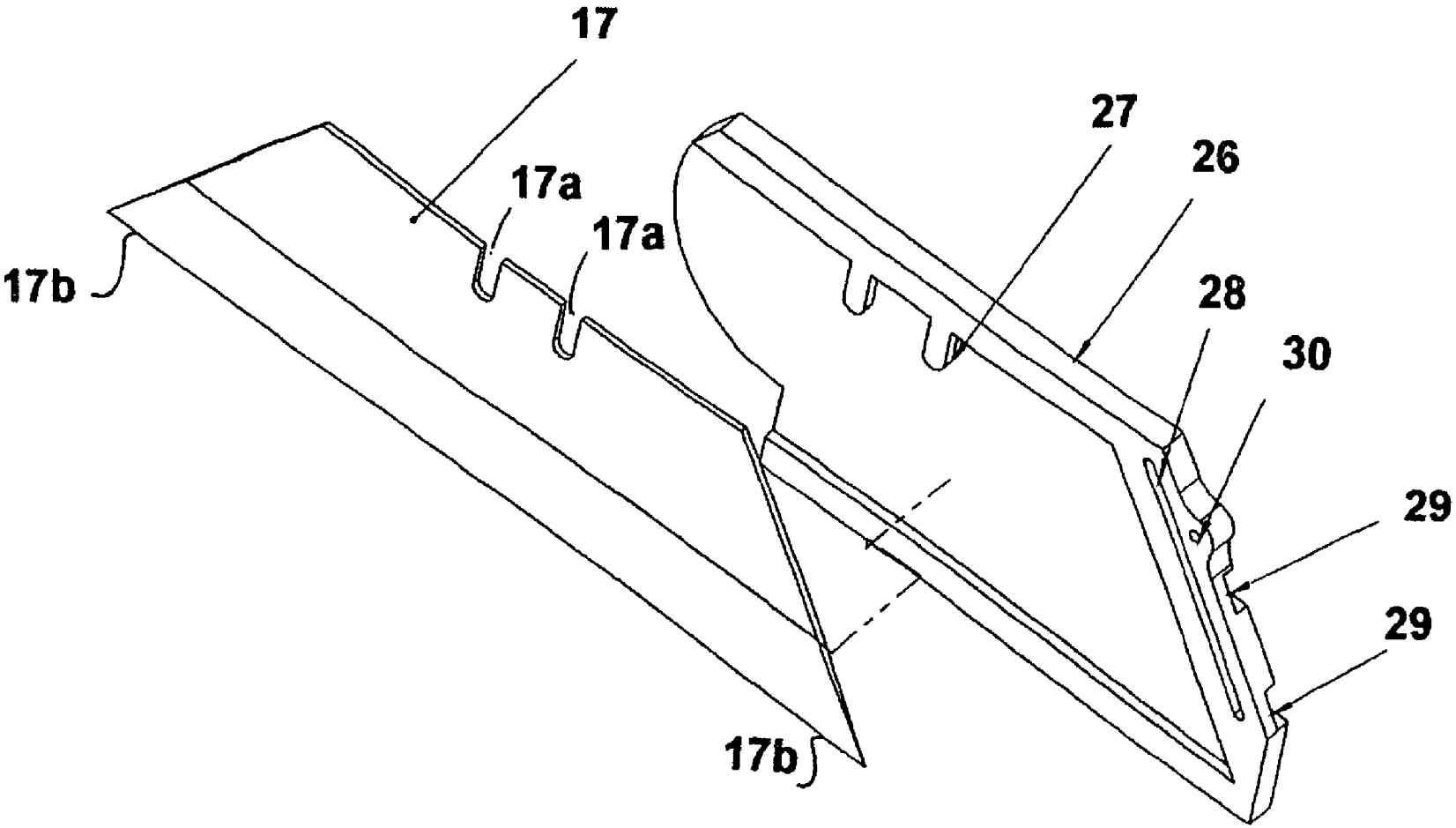
FIG. 10 is, in perspective view, an exploded view of the knife blade and blade carrier of the wallboard cutting tool of FIG. 3.
Figure 11:
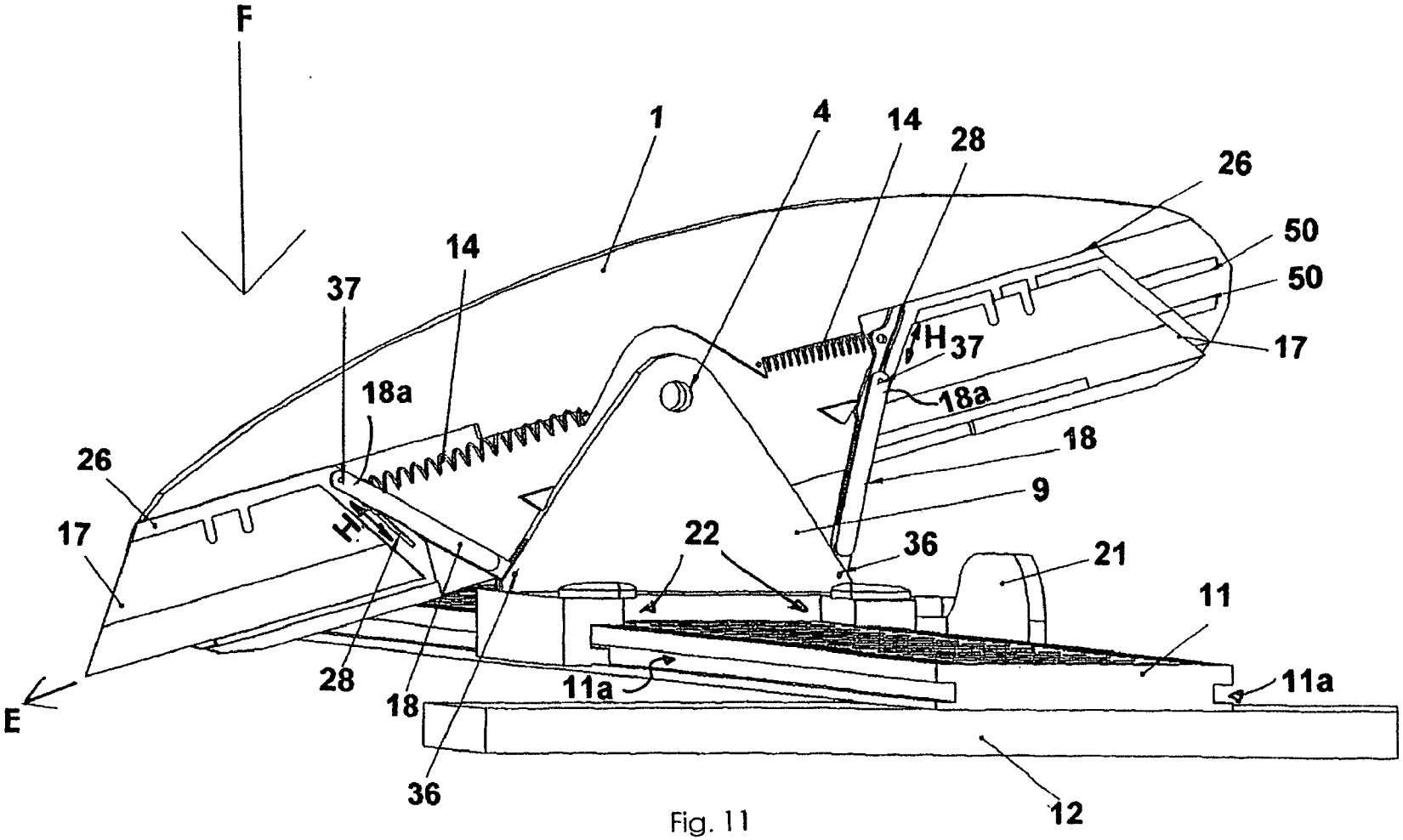
FIG. 11 is, in perspective partially cutaway view, the cutting tool of FIG. 3 illustrating the pivoting action and blade extension as a result of applying a downward force to one end of the cutting head.

The wallboard cutting tool is used by positioning the reference face 31 of the T-Square fence 12 against the edge 32*a* of the wallboard to be cut along its surface 32, with one side of the cutting tool placed at the starting edge 33*b* of the wallboard panel to be cut. The position of the cutting tool along T-Square arm 11 is adjusted by releasing cam lock 20 and slidably positioning the housing 1, by sliding base 10 to the desired distance from wallboard edge 33*a* as indicated by indicia pointer 39, indicia 40, 41 and scales 42 through 48 marked on T-Square arm 11. Once positioned, the cutter is locked in place by rotating cam lock 20 to its locked position. End 1*a* of housing 1 is then depressed downwardly towards edge 33*b* of the wallboard panel 32 so that the first blade, that is knife blade 17 in end 1*a* extends to engage with the wallboard panel 32 at edge 33*b*. The housing is then drawn in direction G across the wallboard surface 32 while maintaining the T-Square fence 12 in sliding contact with the wallboard edge 33*a* as shown in FIGS. 6 and 7, resulting in a cut or score line 34 extending almost entirely across the wallboard panel 32. When the T-Square fence 12 reaches the end of the wallboard panel (or the desired length of cut) as shown in FIG. 8, housing 1 is rotated back to its neutral position and then rotated in the opposite direction so as to depress end 1*b* downwardly to the first so that the second blade, that is knife blade 17 in end 1*b* is extended. The housing, base and T-Square are then drawn back in the direction opposite to direction G as shown in FIG. 9 resulting in a completion cut or score line 35 which joins co-linearly with cut or score line 34.

The cutter of the present invention cuts wallboard to both length and width. The pivoting double cutter housing 1 slides along on the T-Square arm 11 over a graduated ruler marked on arm 11 specifically laid out for wallboard. The ruler may be graduated in eighths of an inch—for cutting the four different lengths of wallboard it is scaled in total inches or feet and inches measure. The outer edges of the ruler are laid out for width cuts, zero to twenty four and twenty four to forty eight inches. The scales and resolution of the ruler gradations is not intended to be limiting. Nor is the use of the imperial measurements of feet and inches, as the ruler and scales may also be metric where and if appropriate.

By way of example, what follows is the example of cutting wallboards having dimensions of eleven feet six and a quarter by forty one inches. The boards are stacked against a wall.

First, a twelve foot sheet length is selected. The base is slid along the ruler until the length measurement is located between the indicator arrows. If the measurement was given in feet and inches it would be set at odd foot measure six and one quarter inches or one hundred thirty eight and a quarter inches if total inch measurement was given. The base then locked in place with the cam lock. The edges of the fence is then set along the end of the wallboard. Pressure is applied to the forward portion of the rocker housing so as to automatically extend the corresponding blade. The cutter is then drawn down towards the floor keeping the fence tight against the end of the sheet and enough pressure is applied to the end of the cutter to score the paper with the knife blade. When the tool stops, that is runs into the floor, pressure is applied to the opposite end of the rocker housing and the cutter is then drawn upwards to score the last eight and one half inches. The process is repeated on the back of the board. The sheet is then broken to length. Alternatively, the board is snapped after the initial score and the back paper then cut with a utility knife.

For the width cut, forty one inches is located on the scale and the rocker housing and base locked in place. The T-Square is set on the top edge of the wallboard. The user can then either apply forward pressure to the cutter head and draw the tool toward themselves or apply pressure to the back of the cutter and push the tool away, sliding the tool along the top edge of the wallboard. The user stops at the end of the board and reverses the process to finish scoring the last eight and one half inches. The cut is completed by scoring the back of the board or breaking and using a utility knife to cut the back paper.

When doing multiple width cuts from a single sheet, the user simply uses a rasp to smooth the broken edge which will ease sliding the fence and keep the cut straight.

To cut in slightly off square situations, the user makes a slot at either end of the board using the wall board cutter. A chalk line is inserted in one slot, stretched to the other slot and the line snapped. The sliding base is unlocked and the cutter is used to help stabilize the cut following the chalk line making it less wavy and for a cleaner break.

Additions to the wallboard cutter may include a rasp and a utility knife with quick release mechanisms, thereby providing an integrated tool.

Figure 12:
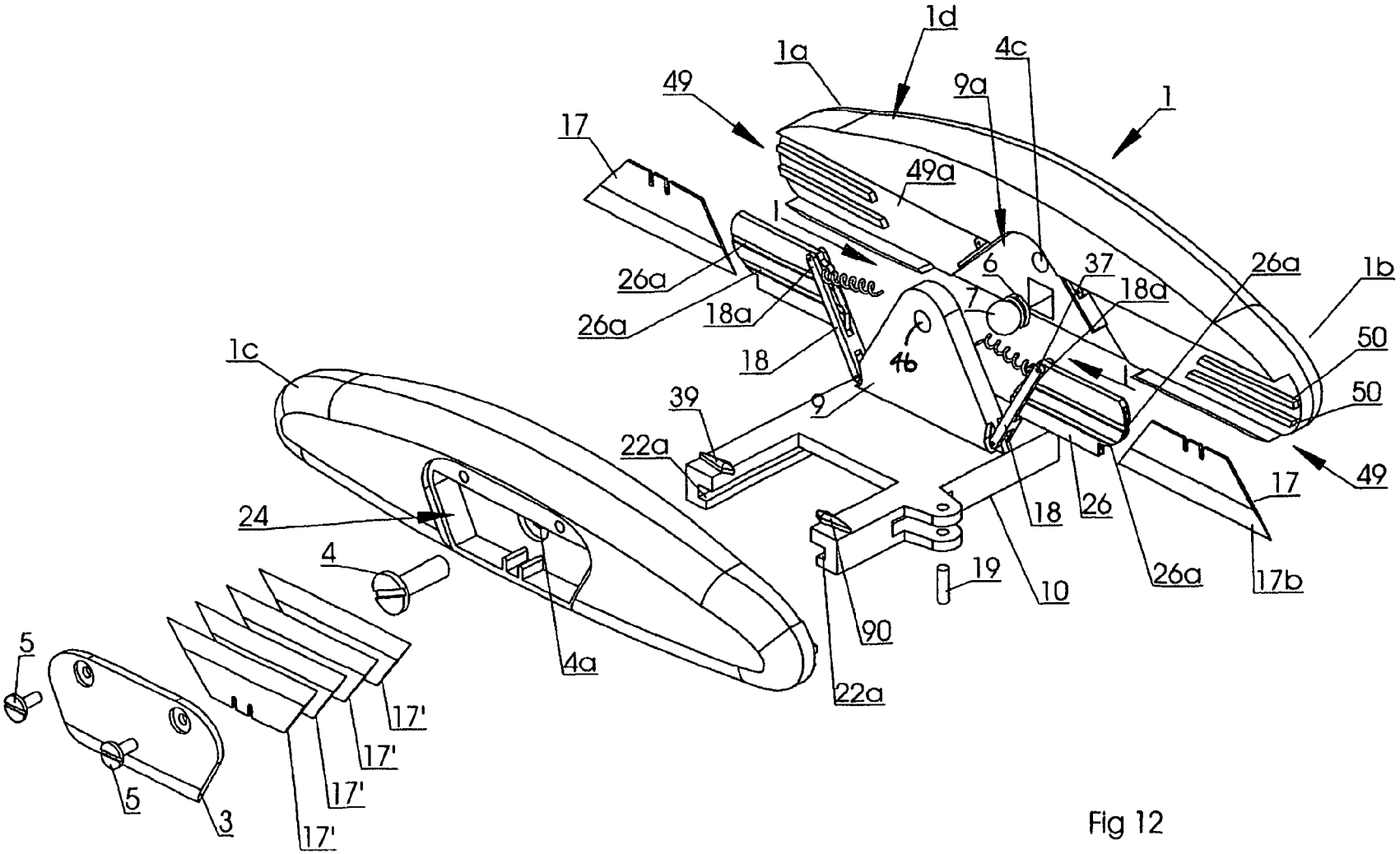
FIG. 12 is a perspective exploded view from a first side of the wallboard cutter according to the present invention.
Figure 13:
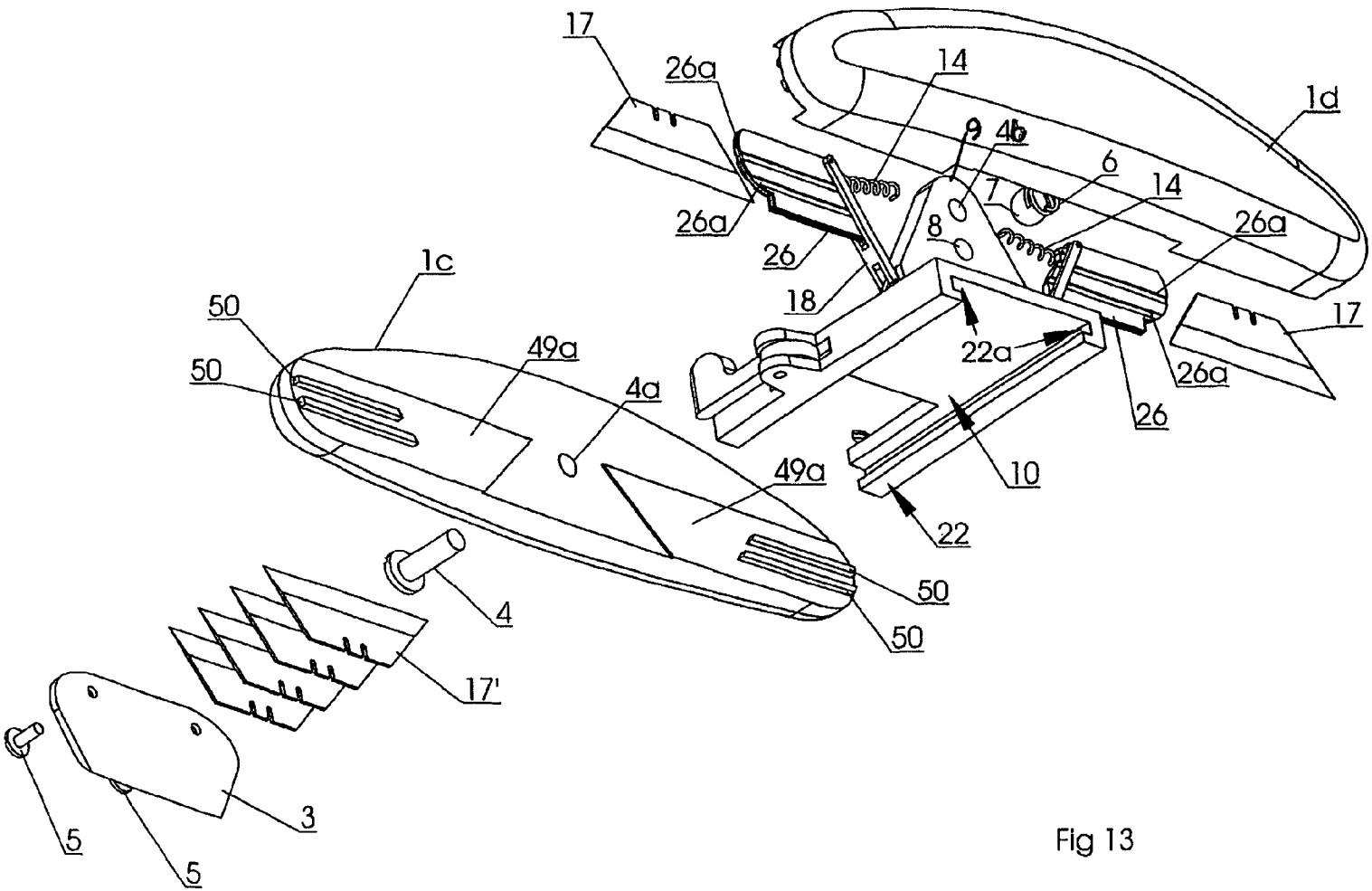
FIG. 13 is a perspective exploded view from a second opposite side of the wallboard cutter of FIG. 12.
Figure 14:
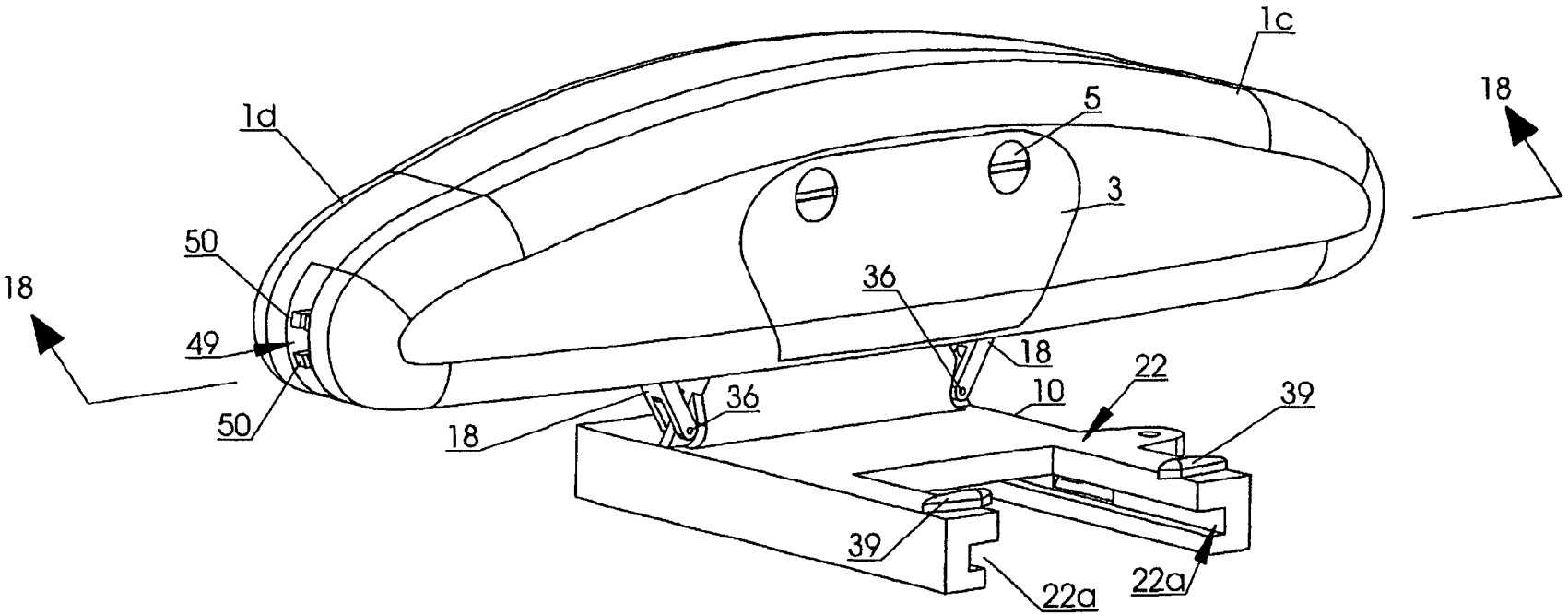
FIG. 14 is a first side perspective view of the assembled wallboard cutter of FIG. 12.
Figure 15:
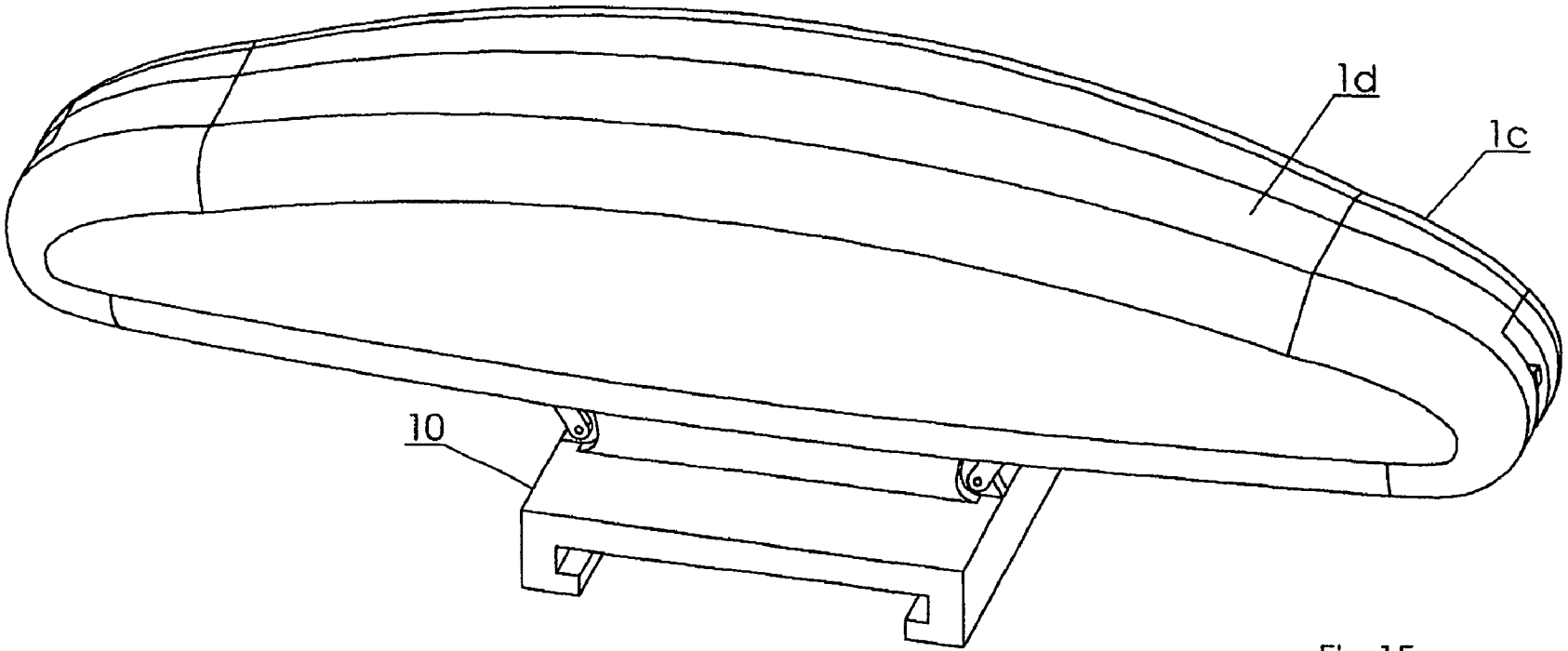
FIG. 15 is a second side perspective view of the assembled wallboard cutter of FIG. 13.
Figure 16:
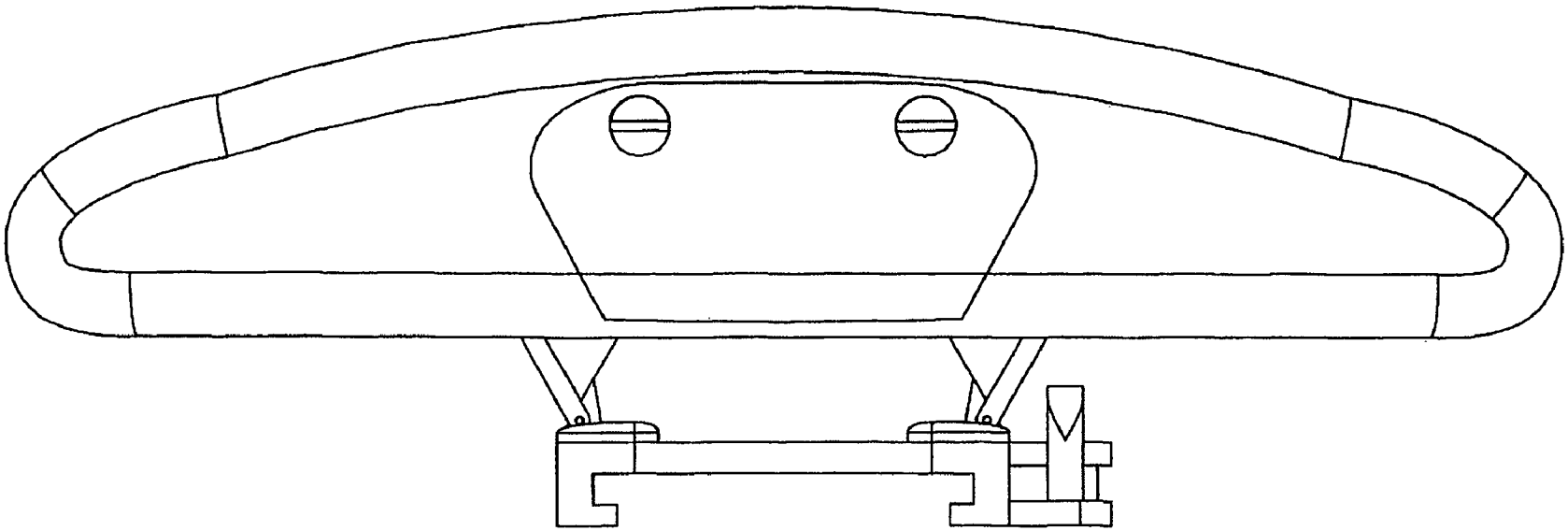
FIG. 16 is a first side elevation view of the wallboard cutter of FIG. 14.
Figure 17:
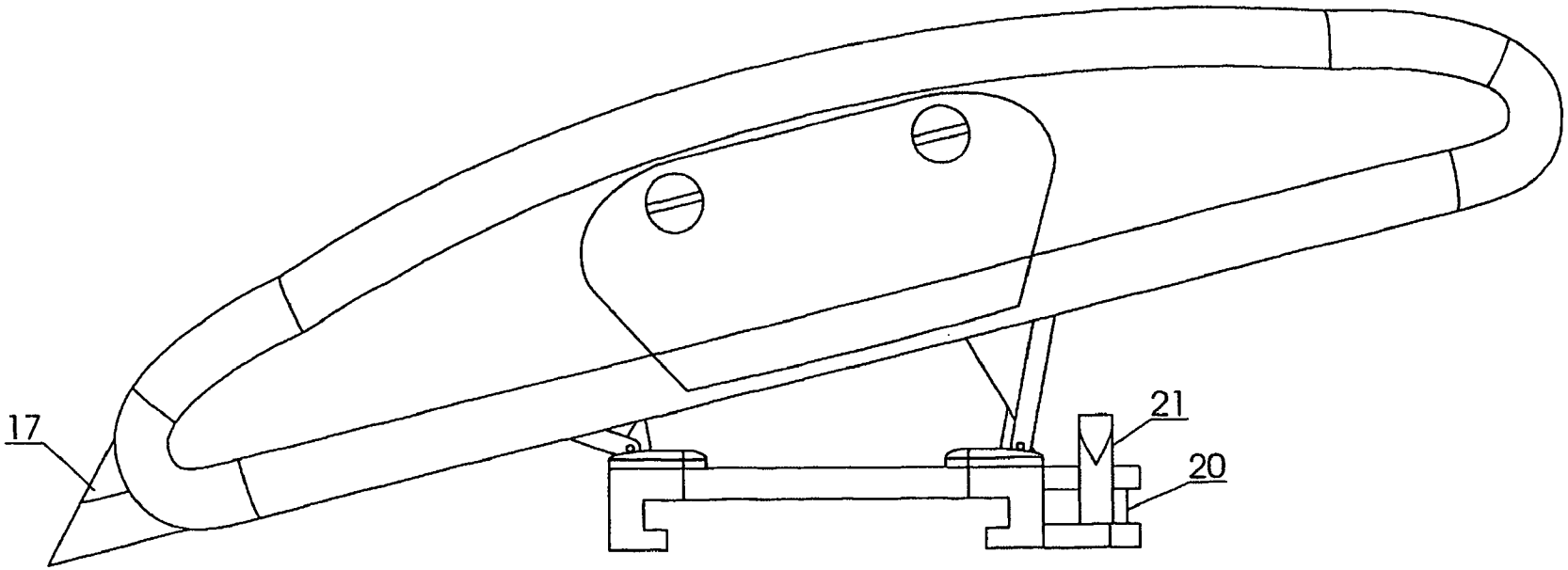
FIG. 17 is the wallboard cutter of FIG. 16 with a first end lowered so as to extend a knife blade from the lowered end.
Figure 18:
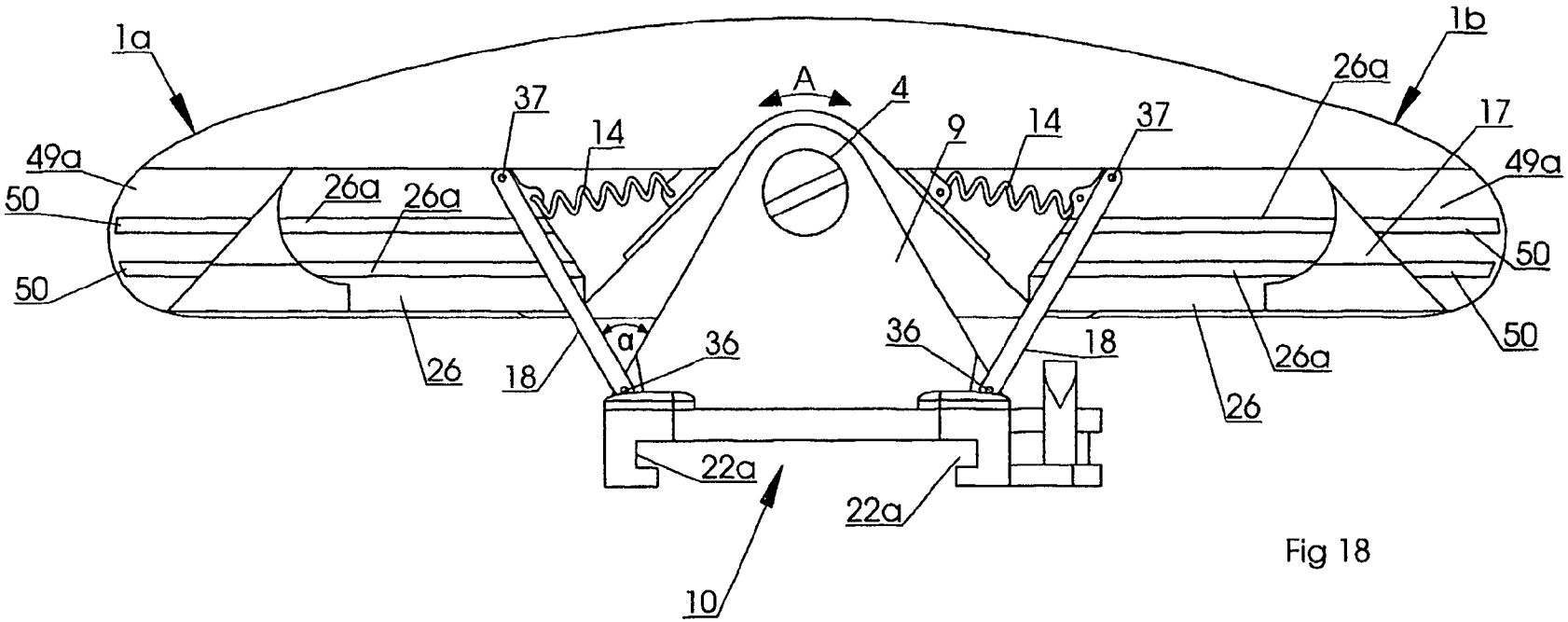
FIG. 18 is a cross-sectional view along line 18—18 in FIG. 14.
Figure 19:
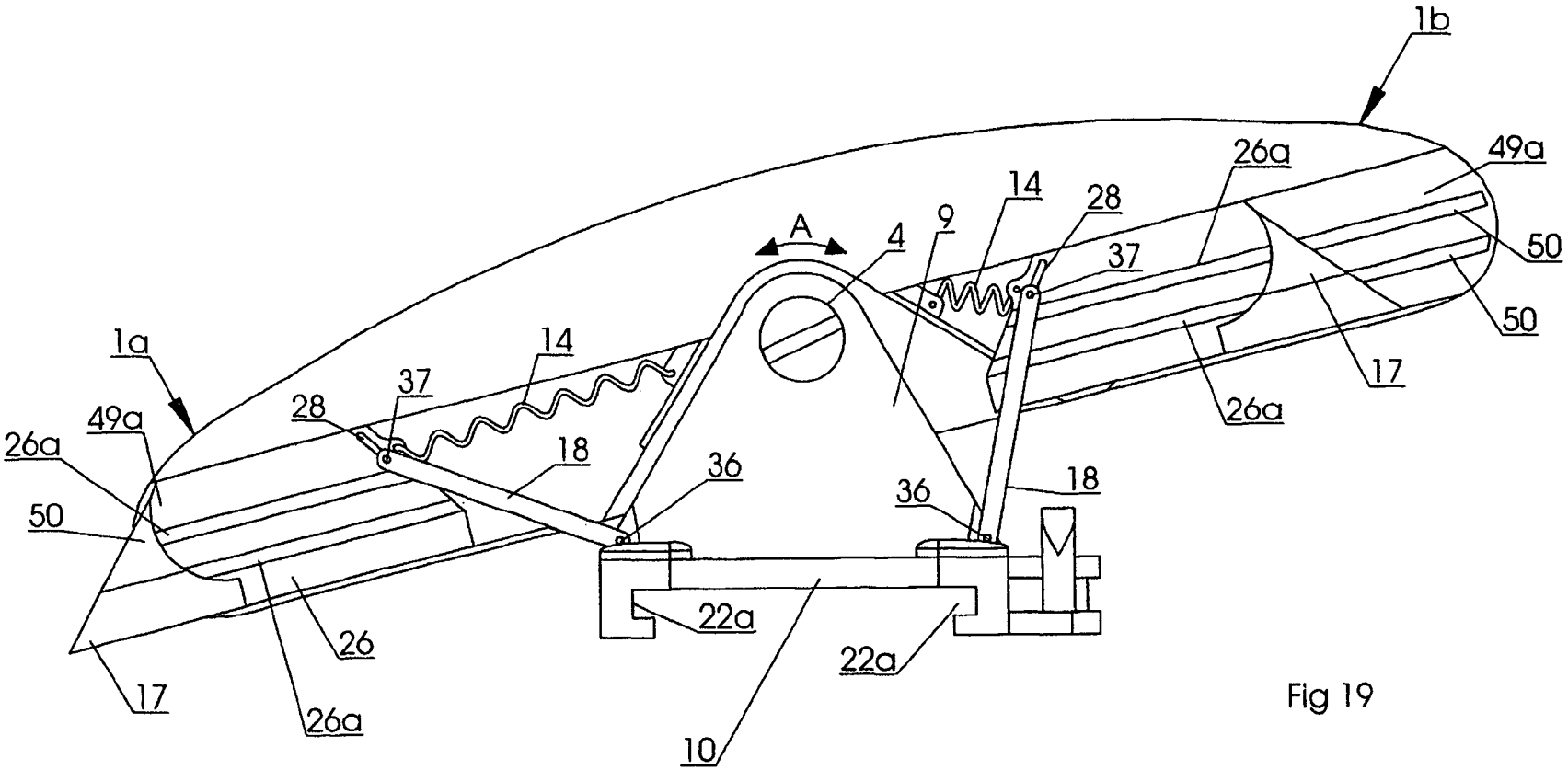
FIG. 19 is the view of FIG. 18 with the first end lowered as in FIG. 17 so as to extend the knife blade from the lowered end.

Cutter rocker housing 1 may in one embodiment include individual head components 1*c* and 1*d* which, when assembled together, sandwich blades 17 and the corresponding blade carriers 26 within the blade channels 49 defined in ends 1*a* and 1*b* between head components 1*c* and 1*d*. As better seen in FIG. 12, both sides of blade carriers 26 have longitudinally extending grooves 26*a* for sliding mating onto correspondingly sized longitudinally extending rails 50 mounted or formed on the interior planar, opposed-facing side walls 49*a* of blade channels 49. Each blade 17 has upper notches 17*a* which mate with blade locator tabs 27 within blade carrier 26 so that blade 17 is held rigidly in a releasable mounting within carrier 26. Thus with blade 17 mounted within carrier 26 so as to extend one of the reversible cutting ends 17*b* from the open end 26*b*, the opposite closed end of carrier 26 is held within the corresponding channel 49 in sliding engagement on rails 50 and constrained in sliding translation by the mechanical linkage, as describe above, of carrier end 18*a* of arm 18 engaged by pin 37 to slot 28 for sliding movement in direction H of pin 37 in slot 28. The opposite ends of arms 18 are rotatably pinned to base 10 by base pins 36. Thus arms 18 are free to rotate relative to both base 10 and blade carriers 26. When blade carriers 26 are in their inward positions, for example when housing 1 is in its neutral position, angle a may be in the range of 20–30 degrees, and in a preferred embodiment the latter 30 degrees.

As described above, springs 14 provide the return biasing force biasing the blade carriers 26 inwardly in direction 1 towards the pivot mount of housing 1 about pivot pin, screw or bolt 4 journalled through aperture 4*a* in head component 1*c*, aperture 4*b* in support bracket 9 and into releasable mating such as threaded mating in aperture 4*c* in head component 1*d*. Support bracket 9 may be in the form of an upstanding generally equilateral triangle having a rounded upper vertice. Support bracket 9 mounts into a triangular recess 9*a* centrally disposed in head component 1*d*. Recess 9*a* is wider than the corresponding dimensions of support bracket 9 so that housing 1 may pivot or rotate in direction A about the pivot mount of the head components onto support bracket 9, pivotally mounted thereon by pivot pin, screw or bolt 4 or other pivot member. The head of bolt 4 and aperture 4*a* are recessed within a storage compartment 24 for spare blade storage of a plurality of spare blades 17'. The spare blades may be stored within the compartment and secured therein by cover plate 3, itself secured by lugs 5.

Base 10 includes a parallel, opposed facing pair of channels 22*a* in base rail 22 which are sized for a snug sliding interlocking fit with corresponding channels 11*a* along the sides of T-Square arm 11.

Figure 20:
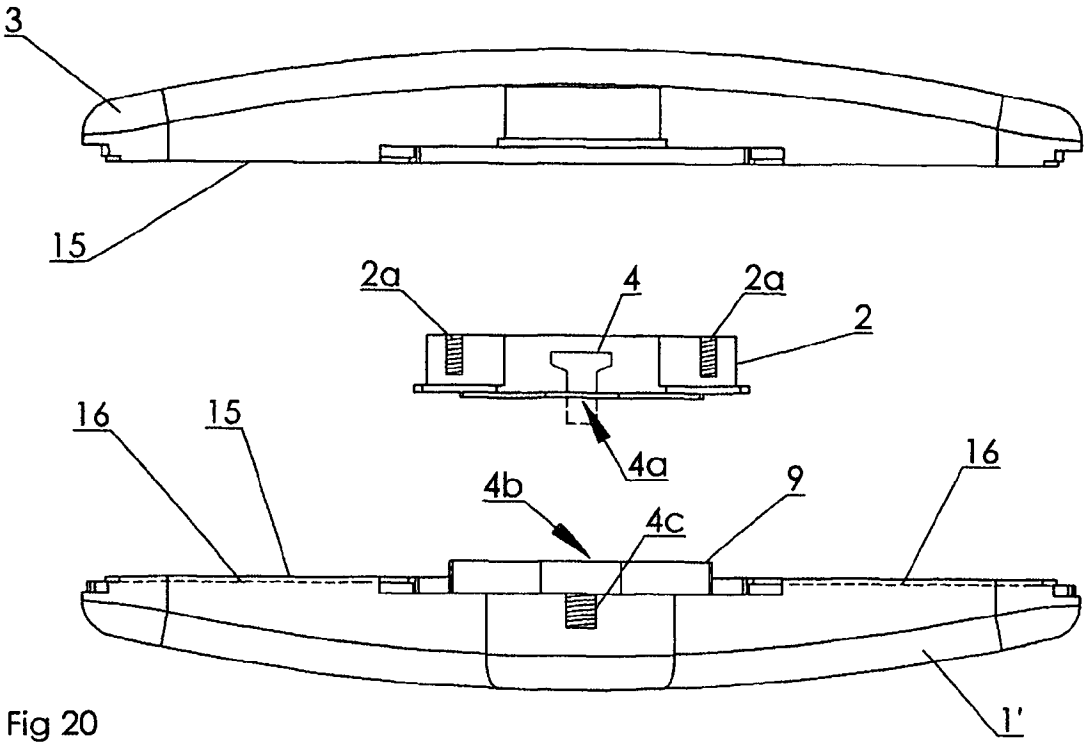
FIG. 20 is, in partially exploded plan view, the cutting head assembly according to an alternative embodiment of the present invention.
Figure 21:
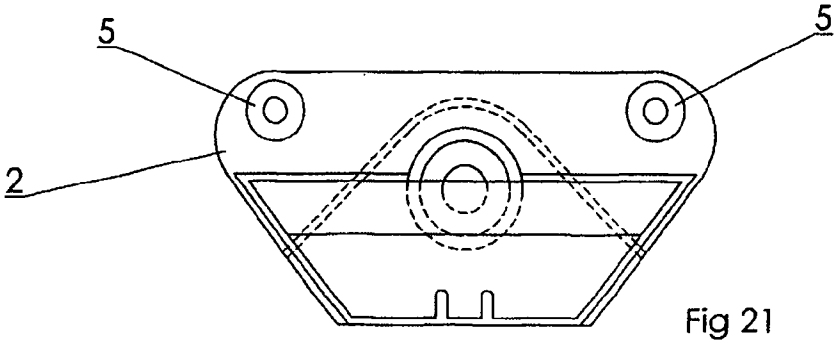
FIG. 21 is, in front elevation view, the attaching plate of the embodiment of FIG. 20.
Figure 22:
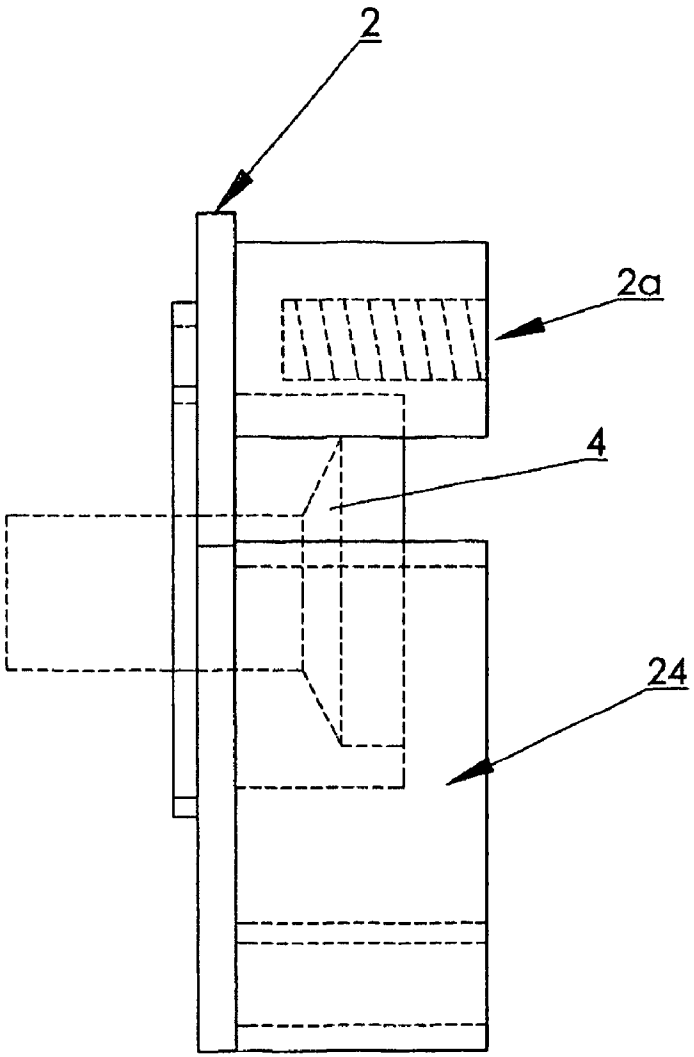
FIG. 22 is, in side elevation view, the attaching plate of FIG. 21.

In the further preferred embodiment illustrated commencing in the exploded plan view of FIG. 20, instead of sandwiching support bracket 9 between head components 1*c* and 1*d*, the main body 1' of the cutting head mounts to a separate attaching plate 2 better seen in FIGS. 21 and 22 so as to sandwich therebetween support bracket 9. In this embodiment, in essence, the function served in the previous embodiment by head component 1*c*, is broken into two separate elements, namely attaching plate 2, and cover plate three. As before, pivot bolt 4 journals through aperture 4*a*, and then through aperture 4*b* in support bracket 9 and into threaded aperture 4*c* to thereby pivotably mount the assembled head including main body 1', attaching plate 2 and cover plate 3 about support bracket 9.

Cover plate 3 mounts to main body 1' so as to enclose attaching plate 2, thereby also covering the opening into blade storage 24 within attaching plate 2. Cover plate 3 is mounted onto main body 1' by means of, for example, threaded lugs 5 journalled through apertures 3*a* so as to engage corresponding threaded apertures 2*a* in attaching plate 2.

Figure 23:
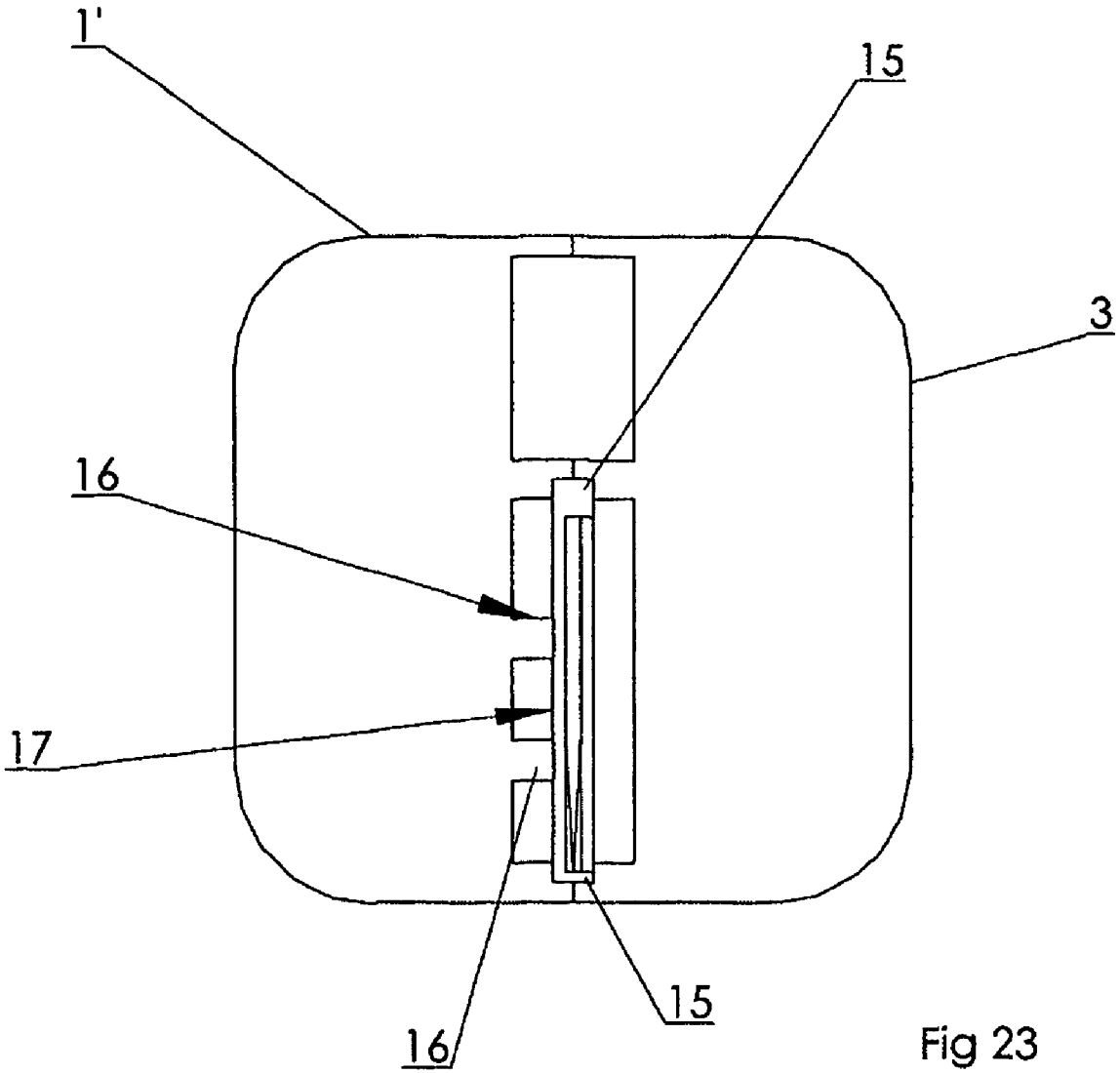
FIG. 23 is a sectional view along line 23—23 in FIG. 28.
Figure 24:
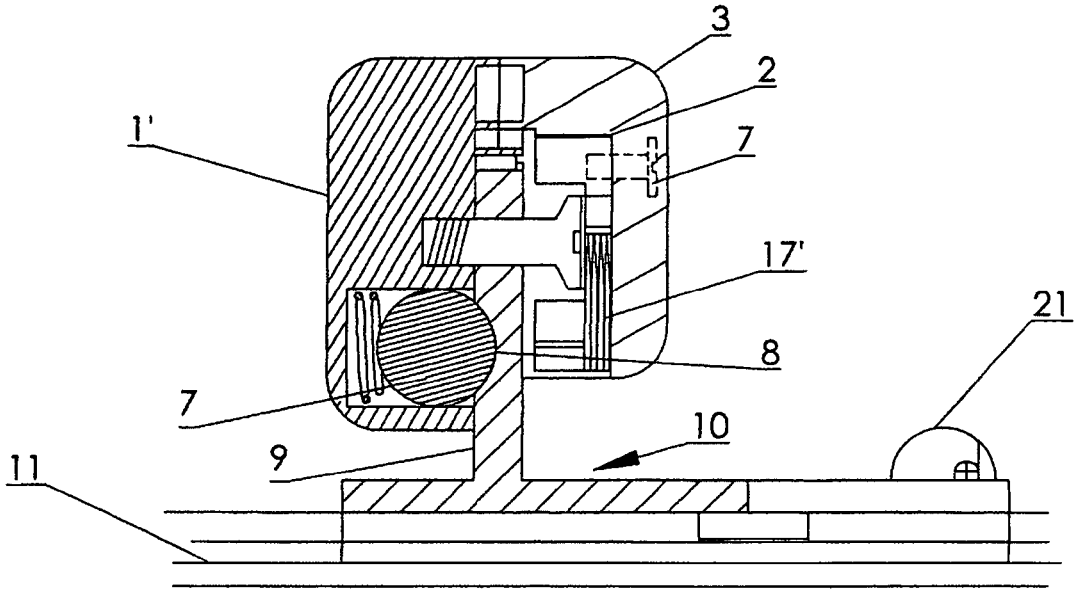
FIG. 24 is a sectional view along line 24—24 in FIG. 28.
Figure 25:
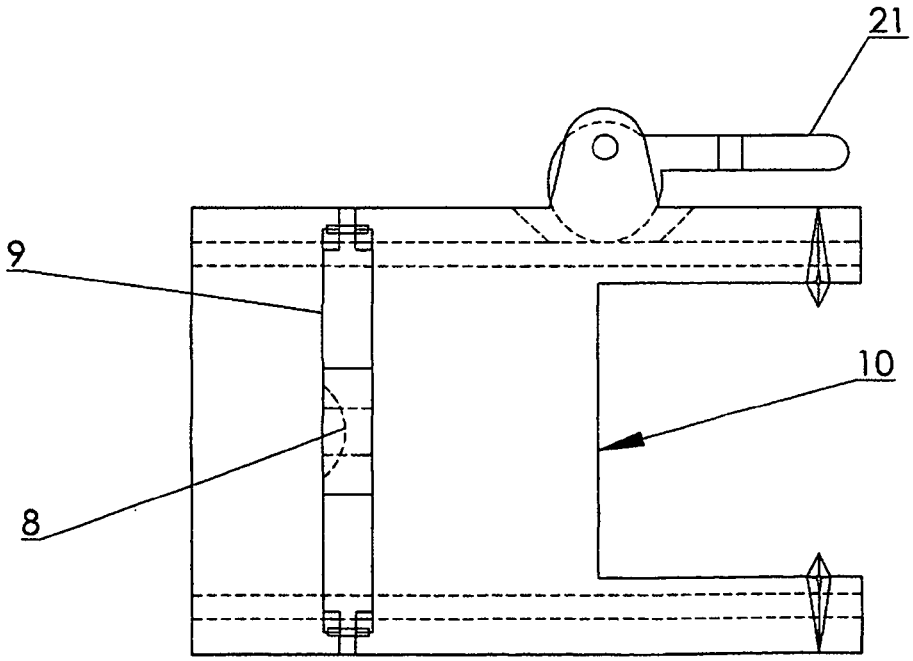
FIG. 25 is a partially cut away plan view of the base of the embodiment of FIG. 28.
Figure 26:
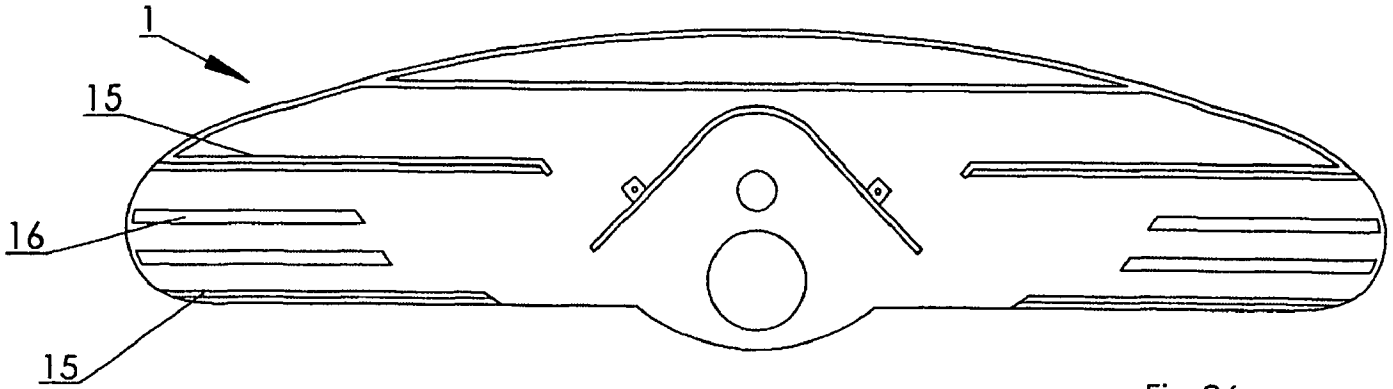
FIG. 26 is, in elevation view, the main body of the cutting head assembly of FIG. 20.
Figure 27:
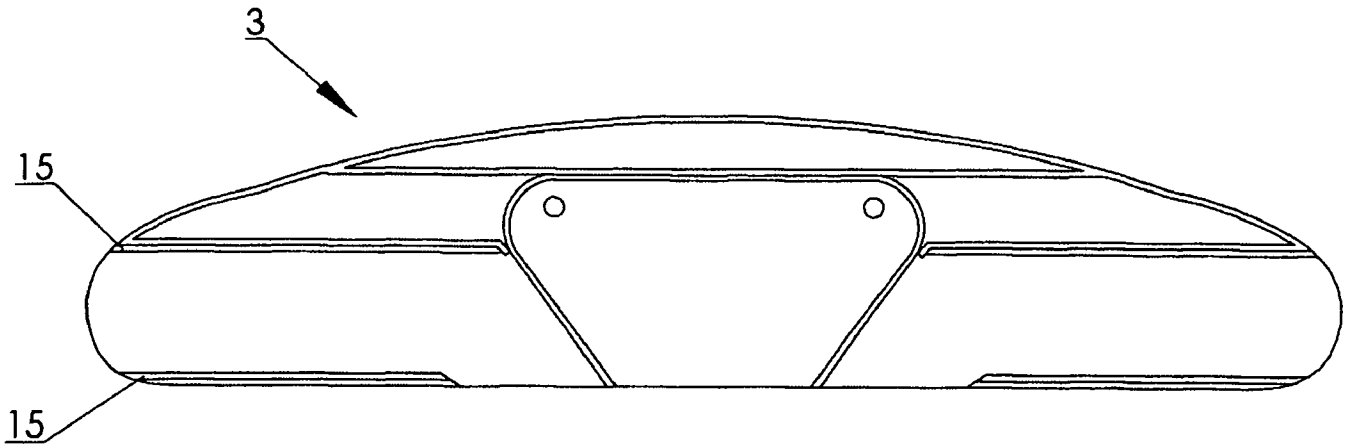
FIG. 27 is, in elevation view, the cover plate of the cutting head assembly of FIG. 20.
Figure 31:
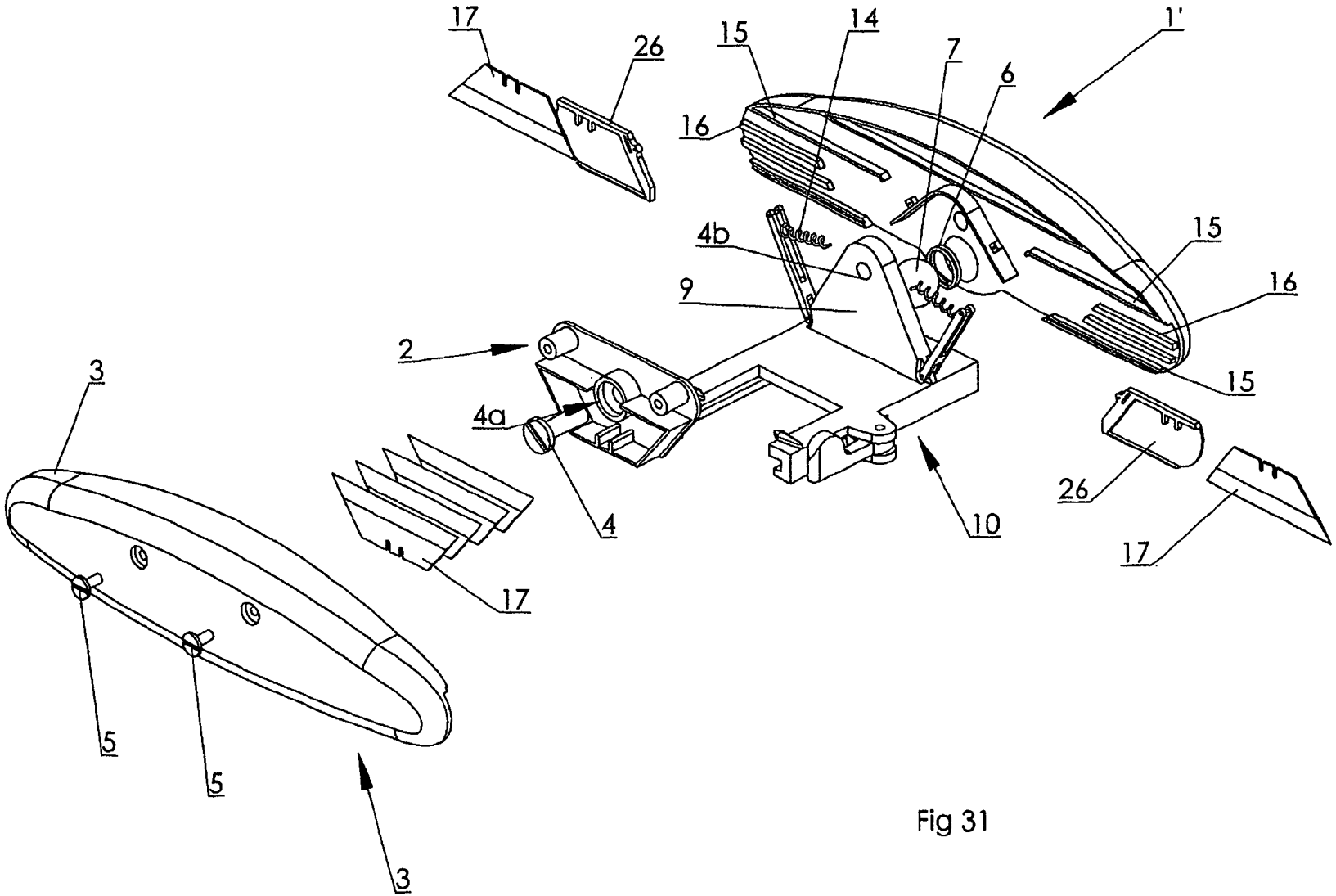
FIG. 31 is an exploded view of the wallboard cutting tool of the present invention.

Guide rails 15 are formed in the interface between main body 1 and cover plate 3 for slidably carrying blade 17 and its corresponding carrier 26 in both ends of the assembled cutting head. Thus the upper and lower edges of blade carrier 26 slide in the corresponding rails 15 supported laterally by side guides 16 in cover plate 3 as better seen in the cross sectional view of FIG. 23.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A wallboard cutter comprising:

a rocker housing pivotally mounted about a pivot mount on a base;

said base slidably mounted on a T-Square so as to selectively slide along an upper side of a ruler arm of said T-Square, said rocker housing selectively pivotable about an axis of rotation parallel with said ruler arm;

an oppositely disposed pair of cutting blade assemblies slidably mounted in oppositely disposed coplanar array within a corresponding pair of cavities in said rocker housing, said pivot mount between said pair of cavities, a drive linkage mounted so as to cooperate between said base and said pair of cutting blades alternatingly to drive a cutting edge of a first blade assembly of said pair of cutting blade assemblies from said rocker housing in a first direction upon pivoting of a corresponding first side of said rocker housing downwardly and retain a second blade assembly of said pair of cutting blade assemblies within said rocker housing, or to drive said second blade assembly from said rocker housing in a second direction opposite said first direction upon pivoting of a corresponding second side of said rocker housing, opposite said first side, downwardly and retain said first blade assembly within said rocker housing, wherein when said first side of said rocker housing is pivoted downwardly about said pivot mount said first blade assembly is rotated downwardly into cutting engagement with a sheet of wallboard when said T-Square is mounted on an edge of said sheet so as to lay said ruler arm flush on the sheet of wallboard, and wherein when said second side of said rocker arm is pivoted downwardly about said pivot mount said second blade assembly is rotated downwardly into cutting engagement with the sheet of wallboard when said T-Square is mounted on the edge of the sheet so as to lay said ruler arm flush on the sheet of wallboard;

and wherein said rocker housing is adapted to provide a handle for gripping by a user so that the user when gripping the handle translates said housing, blade assemblies, base and T-Square over the sheet of wallboard with said first or second blade assemblies in corresponding said cutting engagement when said housing is simultaneously pivoted downwardly on said first or second side respectively.

2. The device of claim 1 further comprising resilient biasing means mounted in said housing and cooperating with said pair of cavities so as to resiliently bias said pair of blade assemblies inwardly of said housing into said cavities.

3. The device of claim 2 wherein said cavities are elongate so as to extend between oppositely disposed first and second openings in corresponding said first and second sides of said housing and wherein said resilient biasing means includes first and second resilient biasing means, and wherein said drive linkage urges said first or second blade assemblies linearly along said corresponding first or second cavities upon corresponding said downward pivoting of said first and second sides of said housing against the return biasing force of first and second resilient biasing means respectively.

4. The device of claim 3 Wherein said drive linkage includes first and second drive arms rotatably mounted at first ends thereof to said base and rotatably mounted at opposite second ends thereof to said first and second blade assemblies respectively.

5. The device of claim 4 wherein each of said first and second blade assemblies has a substantially vertical slot formed therein, and wherein said second ends of said first and second drive arms are respectively slidably mounted in a corresponding said substantially vertical slot whereby upward rotational ranges of motion of said first and second sides of said housing are extended upwardly when said first and second blade assemblies are retracted into a stowed position within the corresponding said first or second cavity, whereby the opposite side, said second or first side of said housing respectively, have a corresponding extended downward rotational range of motion about said pivot mount.

6. The device of claim 5 wherein said drive arms are linear and wherein said pivot mount is a pivot member extending between said base and said housing along said axis of rotation, and wherein said first ends of said drive arms are rotatably mounted on opposite adjacent sides of, and below, said pivot member, and wherein said substantially vertical slots are formed in inwardly disposed ends of said blade assemblies.

7. The device of claim 6 wherein said housing is elongate so as to extend and be elongate between said first and second openings so that said housing forms an elongate handle extending longitudinally along its length orthogonally from said axis of rotation.

8. The device of claim 7 wherein said first and second openings are at outermost distal ends of said first and second sides of said housing.

9. The device of claim 8 wherein a storage compartment is formed in said housing for removably storing spare blades to replace blades in said first or second blade assemblies.

10. The device of claim 8 wherein said base further comprises a selectively releasable lock for locking said base at a selected position along said ruler arm.

11. The device of claim 8 wherein said ruler arm has a parallel array of length markings extending along a length of said ruler arm so that said blades are selectively positionable along said ruler arm at known distances, marked in said length markings, corresponding to dimensions of the sheet of wallboard when said T-Square is mounted on the sheet of wallboard.

12. The device of claim 8 wherein said first and second blade assembly includes first and second blades removably mounted so as to be carried in a corresponding first and second blade carrier mounted slidably in corresponding said first and second cavities for sliding translation along said first and second cavities in oppositely disposed first and second linear directions substantially radially outwardly of said pivot member.

13. The device of claim 12 wherein said first and second blades are held in said carriers by sandwiching of inner ends of said blades within said carriers so as to leave outer ends of said blades disposed outwardly of said carriers, and outwardly along said cavities so that when in extended positions said carriers are within said cavities adjacent corresponding said openings and only said cutting edges protrude outwardly of said openings.

14. The device of claim 13 wherein said substantially vertical slots are formed in inner ends of said carriers corresponding to said inner ends of said blades.

* * * * *